US007679053B2

(12) United States Patent
Schneider et al.

(10) Patent No.: US 7,679,053 B2
(45) Date of Patent: Mar. 16, 2010

(54) MULTIPLE SAMPLE SOURCES FOR USE WITH MASS SPECTROMETERS, AND APPARATUS, DEVICES, AND METHODS THEREFOR

(75) Inventors: Bradley B. Schneider, Bradford (CA); Thomas R. Covey, Richmond Hill (CA)

(73) Assignees: MDS Analytical Technologies, A Business Unit of MDS Inc., Concord (CA); Applera Corporation, Framingham, MA (US)

( * ) Notice: Subject to any disclaimer, the term of this patent is extended or adjusted under 35 U.S.C. 154(b) by 329 days.

(21) Appl. No.: 11/860,899

(22) Filed: Sep. 25, 2007

(65) Prior Publication Data

US 2008/0073502 A1 Mar. 27, 2008

Related U.S. Application Data

(60) Provisional application No. 60/826,811, filed on Sep. 25, 2006, provisional application No. 60/867,123, filed on Nov. 23, 2006.

(51) Int. Cl.
*H01J 49/00* (2006.01)

(52) U.S. Cl. ..... 250/285; 250/281; 250/282; 250/288; 250/423 R; 250/424

(58) Field of Classification Search ..... 250/281, 250/282, 285, 288, 423 R, 424, 425, 426, 250/427, 423 P, 423 F
See application file for complete search history.

(56) References Cited

U.S. PATENT DOCUMENTS

| | | | |
|---|---|---|---|
| 5,576,540 | A | 11/1996 | Jolliffe |
| 6,501,073 | B1 | 12/2002 | Mylchreest et al. |
| 6,541,768 | B2 | 4/2003 | Andrien, Jr. et al. |
| 6,621,075 | B2 | 9/2003 | Hindsgaul et al. |
| 6,657,191 | B2 | 12/2003 | Park |

*Primary Examiner*—Jack I Berman
*Assistant Examiner*—Hanway Chang
(74) *Attorney, Agent, or Firm*—Torys LLP

(57) ABSTRACT

A method for introducing samples through a boundary member partially defining a chamber at an entrance point coaxial to a sampling inlet of a mass spectrometer is described. Field-free conditions can be established in at least one region of the chamber. The sample can be introduced adjacent to the sampling inlet, and introducing at least a second sample can be introduced through at least one other entrance point in the chamber not adjacent to the sampling inlet. An apparatus having a sampling inlet and a boundary member partially defining a chamber is also described. Field-free conditions can be established in at least one region of the chamber, and there can be a first aperture in the boundary member through which a source emits sample. Related devices, uses and mass spectrometers are also described.

23 Claims, 25 Drawing Sheets

Doubly Charged Calibrants

Analytical sprayer: 10pg/µL reserpine

Calibrant sprayer: 1000pg/µL glufib

Singly Charged Calibrants

Analytical sprayer: 10pg/µL reserpine

Calibrant sprayer: 1000pg/µL leucine enkephalin

MULTIPLE SAMPLE SOURCES FOR USE WITH MASS SPECTROMETERS, AND APPARATUS, DEVICES, AND METHODS THEREFOR

This application claims the benefit of U.S. Provisional Application Nos. 60/826,811, filed Sep. 25, 2006 and 60/867,123, filed Nov. 23, 2006, the contents of which are incorporated by reference.

FIELD

The applicants' teachings relate to mass spectrometers, and more particularly to the use of multiple sample sources with mass spectrometers.

INTRODUCTION

Mass spectrometry (MS) is a powerful tool for analyzing ionized molecules. Achieving mass accurate results can be critical for the identification of the molecules and/or deciphering the contents of complex mixtures. The atmosphere to vacuum interface, called an atmospheric pressure interface (API) or interface apparatus, is typically designed to provide desolvation and sample preparation before the sample enters the other chambers of the mass spectrometer. A number of different interface configurations are currently used, including apertures, capillary tubes, heated pipes and various combinations of these to separate the atmospheric pressure source region from the first reduced pressure chamber within a mass spectrometer.

SUMMARY

The applicants' teachings relate to methods, apparatus, and devices related to the use of more than one sample source with a chamber or similar apparatus or device suitable for the preparation of a sample for analysis by a mass spectrometer. Multiple sprayer systems methods, apparatus, and devices are provided that exhibit minimal detrimental effects on the analysis of the samples.

According to one aspect, the applicants' teachings provide an interface apparatus for introducing at least one sample into a mass spectrometer, the interface apparatus comprising, a sampling inlet, a boundary member at least partially defining a chamber, the chamber having at least one region where field-free conditions can be established, a first aperture defined in the boundary member through which a first source can emit sample, the first aperture coaxial to the sampling inlet, the sample being directed toward the sampling inlet for passage therethrough, and at least one other aperture defined in the chamber through which at least one other source can introduce molecules into the chamber. The interface apparatus further comprising at least one gas entrance defined in the chamber for allowing the introduction of a gas into the chamber, such that a gas flow stream is established in which gas flows partially through the first aperture and partially toward the sampling inlet, wherein the molecules are directed to the sampling inlet by the gas flow stream. The sampling inlet can lead to a region of the mass spectrometer that is at a lower pressure than the chamber. The first source can be associated with an electromagnetic field and the second source can be sufficiently remote from the first source such that the second source does not have a detrimental effect on the analysis of the sample. The first source and the second source can be located at a distance of at least 3 millimeters from the at least one other source. In various embodiments of the applicants' teachings, the distance can be about 3 millimeters to about 10 centimeters, or more. The sampling inlet can comprise an aperture, an orifice or a capillary, for example. At least one of the sample and the molecules can comprise ions. The molecules can comprise ions, such as ions of the same or opposite polarity to the sample, or neutral molecules. The neutral molecules can become charged before they are analyzed by the mass spectrometer. The molecules can comprise calibrant molecules. The interface apparatus can further comprise at least one heat source. The at least one heat source can be located outside of the chamber, such as in the first source. The heat source can comprise a laminar tube. The sampling inlet can be heated. The gas in the interface apparatus can be curtain gas, and may be heated. The interface apparatus can be used to conduct ion-ion chemistry experiments. The sample and the molecules can be mixed to conduct ion-ion reactions, ion-neutral reactions, charge inversion experiments, external, or internal calibration. The interface apparatus can further comprise means, such as a pneumatic or other gate, for controlling or "gating" the introduction of sample and molecules from the at least one other source into the sampling inlet, such as by controlling an ion source electromagnetic field or other potentials. The gate may comprise mechanical aspects, such as by blocking the introduction of at least one of the sample and the molecules. The gate may comprise electrical aspects, such as reducing or halting power to the at least one of the first source and the at least one other source or varying the potential applied to lens elements, such as the boundary member. The gate may further comprise pneumatic aspects, such as by further comprising a second source of gas for blowing additional gas towards one or both of the sample or molecules and substantially perpendicular to one or both of the first and second sources such that the sample or molecules are prevented from reaching the sampling inlet, wherein the pneumatic gate comprises a means, or a controller, for controlling the additional gas flow. The gate provides control for the introduction of samples or molecules, but need not in all embodiments include a physical barrier to the samples or molecules and can include electrical or other systems to control movement of the samples or molecules.

The interface apparatus can comprise means for introducing the sample and molecules from the at least one other source into the sampling inlet simultaneously. The gating means can produce indexed analysis of the sample and the molecules, which can be used to calibrate the mass spectrometer. The interface apparatus can comprise means, such as a pneumatic or other gating apparatus as described above, for gating the at least one other source by alternating the potential applied to the first source. The interface apparatus can comprise gating by varying the potential applied to the boundary member. In various aspects of the applicants' teachings, the first source can introduce a spray of charged droplets of a first polarity and the at least one other source can introduce a spray of droplets of the opposite polarity to the charged droplets of the first source or as a spray of droplets of neutral polarity and the droplets from the at least one other source can be mixed with the droplets from the first source.

According to various embodiments of the applicants' teachings, the interface apparatus can further comprise a channel member attached to the at least one other aperture into which the at least one other source can introduce molecules through the at least one other aperture and/or a passage member attached to the inside of the boundary member, the passage member positioned adjacent to the at least one other aperture for providing field-free conditions to the molecules introduced into the chamber. The channel member can comprise a tube, and the passage member can comprise conductive material, such as sheet metal, a tube, or any other suitable structure.

According to another aspect of applicants' teachings, a method for introducing sample to a mass spectrometer from at least two different sources is provided. The method can comprise introducing a first sample through a first entrance point defined in a boundary member at least partially defining a chamber, the entrance point coaxial to a sampling inlet of a mass spectrometer, where field-free conditions can be established in at least one region of the chamber, the first sample being introduced substantially adjacent to the sampling inlet, and introducing at least a second sample through at least one other entrance point defined in the chamber at a position not adjacent to the sampling inlet. The chamber used for the method can further define a gas entrance for allowing the introduction of a gas into the chamber, such that a gas flow stream is established in which gas flows partially generally toward the entrance point of the first sample and partially toward the sampling inlet, wherein the at least second sample can be directed to the sampling inlet by the gas flow stream. The introduction of the first sample can be associated with an electromagnetic field and the introduction of the at least second sample can be sufficiently remote from the introduction of the first sample such that the introduction of the at least second sample does not have a detrimental effect on the analysis of the first sample by the mass spectrometer. The first sample can be located at a distance of at least 3 millimeters from the at least second sample. The first sample can be introduced at a location about 3 millimeters to about 10 centimeters or more from the introduction of the at least second sample. The sampling inlet can lead to a region of the mass spectrometer that is at a lower pressure than the chamber. The first source can be associated with an electromagnetic field and the second source can be sufficiently remote from the first source such that the second source does not have a detrimental effect on the analysis of the sample. The first source and the second source can be located at a distance of at least 3 millimeters. In various embodiments of the applicants' teaching the distance can be about 3 millimeters to about 10 centimeters, or more. The sampling inlet can comprise an aperture, an orifice or a capillary, for example. At least one sample can comprise ions. The at least second sample can comprise ions, such as ions of the same or opposite polarity to the first sample, or neutral molecules. The neutral molecules can become charged before they are analyzed by the mass spectrometer. The at least second sample can comprise calibrant molecules.

The method can further comprise providing at least one heat source. The heat source can be capable of heating the first sample and the at least second sample. The at least one heat source can be located outside of the chamber, such as in the first source. The heat source can comprise a laminar tube. The sampling inlet can be heated. The gas in the interface apparatus can be curtain gas, and may be heated. The method can be used to conduct ion-ion chemistry experiments. The first sample and the at least second sample can be mixed to conduct ion-ion reactions, ion-neutral reactions, charge inversion experiments, external, or internal calibration. Ions from the first sample and ions from the at least second sample can be mixed together to conduct ion-ion reactions. Ions from the first sample and neutrals from the at least second sample can be mixed together to conduct ion-neutral reactions. Ions from the first sample and ions of opposite polarity to those of the first sample can be mixed together to conduct charge inversion experiments. Ions from the first sample and ions from the at least second sample can be gated to conduct external calibration. The first sample and the at least second sample can be mixed together to conduct internal calibration. A first sample can be introduced as a spray of charged droplets of a first polarity and the at least second sample is introduced as a spray of droplets of the opposite polarity to the charged droplets of the first sample or as a spray of droplets of neutral polarity and the droplets from the at least second sample are mixed with the droplets from the first sample.

The method can further comprise gating the introduction of sample and molecules from the at least one other source into the sampling inlet, such as by controlling an ion source electromagnetic field or other potentials. The gating can comprise mechanical means, such as blocking the introduction of at least one of the sample and the molecules. The gating can comprise electrical means, such as reducing or halting power to the at least one of the first source and the at least one other source or varying the potential applied to lens elements, such as the boundary member. The gating can comprise pneumatic means, such as by further comprising a second source of gas for blowing additional gas towards one or both of the sample or molecules and substantially perpendicular to one or both of the first and second sources such that the sample or molecules are prevented from reaching the sampling inlet, wherein the pneumatic gating means comprises a controller for controlling the additional gas flow. The method can comprise introducing the sample and molecules from the at least second source into the sampling inlet simultaneously. The gating can produce indexed analysis of the sample and the molecules, which can be used to calibrate the mass spectrometer. The method can comprise gating at least the second sample by alternating the potential applied to the first sample. The method can comprise gating by varying the potential applied to the boundary member.

The method can further comprise providing a channel member attached to the at least one other entrance point into which the at least second sample can be introduced through the at least one other entrance point. The method can further comprise providing a passage member attached to the inside of the boundary member, the passage member positioned adjacent to the at least one other entrance point for providing field-free conditions to the molecules introduced into the chamber.

These and other features of the applicants' teachings are set forth herein.

BRIEF DESCRIPTION OF THE FIGURES

The skilled person in the art will understand that the drawings, described below, are for illustration purposes only. The drawings are not intended to limit the scope of the applicants' teachings in any way. Like references are intended to refer to like or corresponding parts, and in which.

DESCRIPTION OF VARIOUS EMBODIMENTS

Figure 1:
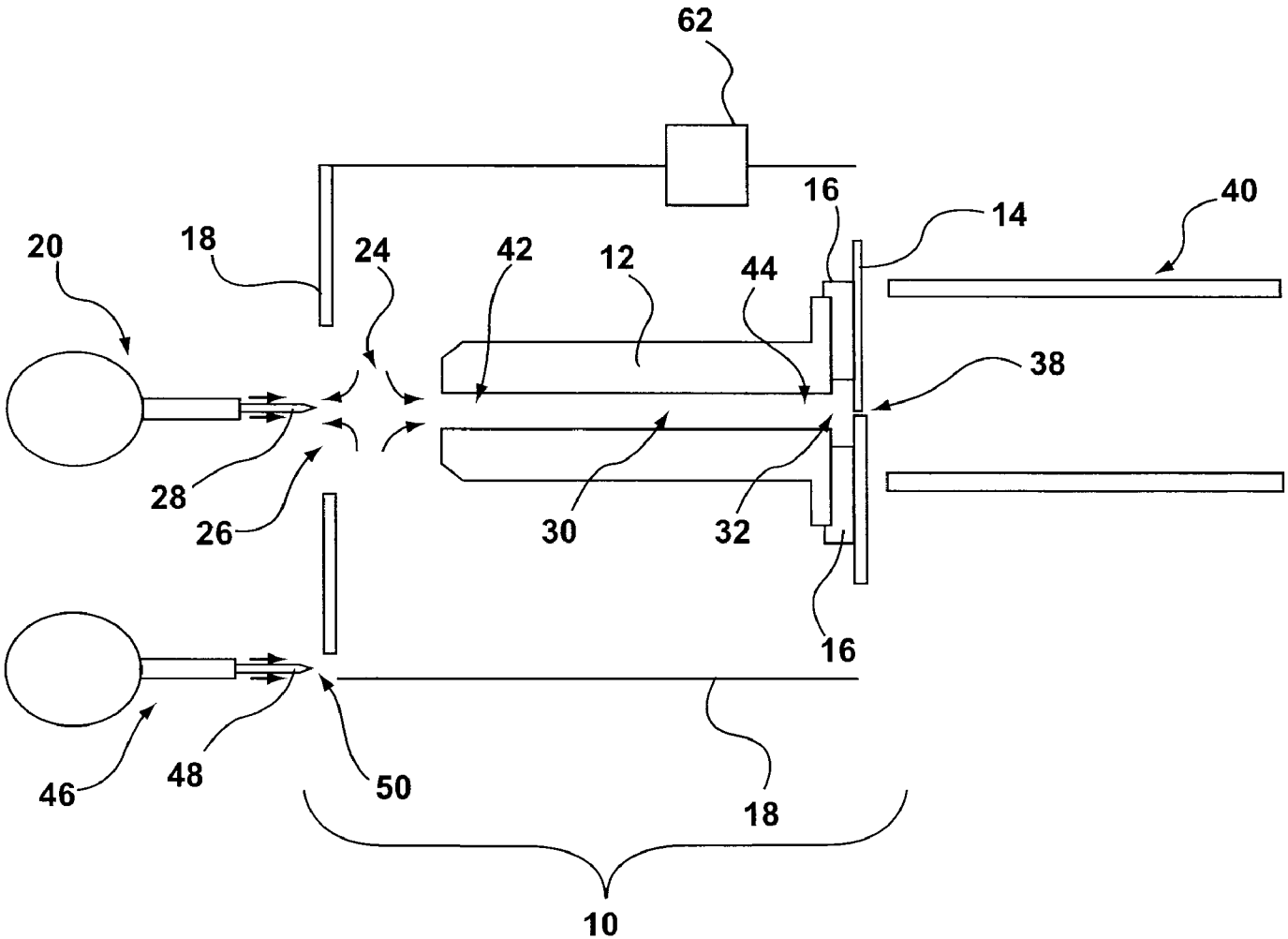
FIG. 1 shows a schematic diagram of an exemplary chamber suitable for use in implementing the applicants' teachings.

Referring now to FIG. 1, according to various embodiments of the applicants' teachings, an example of an apparatus is shown, including a chamber 10, which is upstream from a mass spectrometer, and a sample source 20 configuration is shown. Sample source 20 comprises sample emitter 28. Chamber 10 can comprise an atmospheric pressure interface, and may also comprise a particle discriminator interface, or other similar interface generally known. In various embodiments, sample source 20 can, for example, include a nanoflow electrospray source and sample emitter 28 can include a nanospray tip. Chamber 10 comprises boundary member 18, sometimes referred to as a curtain plate, and orifice plate 14. The boundary member comprises a boundary member aperture 26. Although not shown as such in FIG. 1, chamber 10 can be essentially completely enclosed except for the various apertures. The atmosphere within chamber 10 can be essentially at atmospheric pressure, or may be at a pressure higher or lower than that of the atmosphere outside of the region. In the example shown, sample can be emitted via sample source 20 and sample emitter 28 where the sample emitter 28 can be generally aligned axially with the boundary member aperture 26. Alternatively, the alignment between the sample emitter 28 and the boundary member aperture 26 can be at an angle, such as 90 degrees as generally known.

The skilled person would understand that any ion source suitable for the type of sample to be analyzed can be used in this configuration. For example, for ions, the source can be any ion spray device, electrospray device, a corona discharge needle, a plasma ion source, an electron impact or chemical ionization source, a photo ionization source, an atmospheric pressure (AP) MALDI source, a desorption electrospray (DESI) source, a Direct Analysis in Real Time (DART) source, a thermal desorption source, SONIC spray, Turbo V™ source, or any other known or subsequently-developed source suitable for use in implementing the applicants' teachings described herein, or any multiple combination of the above. A wide variety of suitable ion emitters, such as electrospray or nanospray emitters, and others as known in the art presently and those that are being developed or will be developed in the future, can be used in various embodiments of the applicants' teachings. In accordance with the applicants' teachings, it will be understood by those skilled in the art that the boundary member can enclose a mobility analyzer and that the sampling inlet can interface with a mobility analyzer.

Sample source 20 can operate at atmospheric pressure, above atmospheric pressure, near atmospheric pressure, or in vacuum. Sample can be prepared by any suitable means, as for example prior to being emitted according to methods known in the art currently or those that are being developed or will be developed in the future, and delivered to sample source 20 via a tee junction or other suitable means. Chamber 10, as an example, typically can operate with sample solution flow rates in the range of about 0.1 mL/minute to about 5000 nL/minute, but, as would be understood by those with skill in the relevant arts, higher and lower flows can also be possible. Other interface configurations can operate in various flow regimes without departing from the scope of the applicants' teachings.

In the example shown in FIG. 1, boundary member 18 defines boundary member aperture 26, which is proximate, or adjacent, to sample emitter 28, and through which sample can enter chamber 10. Orifice plate 14 defines orifice plate aperture 38, through which sample can enter a mass spectrometer chamber 40 (completely enclosed chamber 40 not shown). In many current embodiments, mass spectrometer chamber 40 is generally at a lower pressure than chamber 10. Aperture 38 can function as a sampling inlet and can comprise an orifice. As shown in FIG. 1, the boundary member aperture 26, upstream of the orifice plate 14, can be coaxial and in concentric alignment with the sampling inlet. In various embodiments of the applicants' teachings, aperture 38 can be provided by any suitable sampling inlets known, such as capillary inlets, ion pipes, or heated capillaries. For example, aperture 38 can be in the form of a capillary that extends into chamber 10. In various embodiments of the applicants' teachings, aperture 38 may be heated. In these embodiments, heat can be applied to orifice plate 14 or directly to the capillary or pipe by various sources as known, and as will be known, in the art, in such manner that heat energy is transferred to aperture 38.

Referring still to the configuration shown in FIG. 1, chamber 10 further comprises heated laminar flow chamber 12, which is connected to orifice plate 14 through spacer 16. Heated laminar flow chamber 12 defines heated laminar flow chamber lumen 30, which extends through heated laminar flow chamber 12 from inlet 42, which is proximate to boundary member aperture 26, to outlet 44. The region between heated laminar flow chamber outlet 44 and orifice plate aperture 38 is referred to as space 32, which can comprise a particle discriminator space. The region between sample emitter 28 and inlet 42 is referred to as sample region 24. For the embodiment shown in FIG. 1, the sealing of heated laminar flow chamber 12 onto orifice plate 14 establishes laminar flow conditions through channel 30 and therefore inlet 42 can essentially function as a sampling inlet.

Sample source 20 can generate a stream of ionized droplets directed towards aperture 38. The ionized droplets can comprise solvent molecules as a result of preparation of the sample. In many applications, it can be advantageous to substantially remove the solvent from the ions; that is, to substantially desolvate the ions, before analysis of the ions. To substantially desolvate a sample would be understood by the skilled person to mean removing enough solvent from the sample so that ions can produce a readable signal when analyzed by the mass spectrometer. Providing a substantially inert gas, sometimes referred to as curtain gas, to chamber 10 such that it can at least partially flow through first aperture 26 and counter-current to any emitted sample, can be used to assist in the desolvation. Substantial desolvation of the sample can occur as a result of a combination of molecular interactions between the solvent and the curtain gas and, in various embodiments of applicants' teachings, the effects of heat provided by heated laminar flow chamber 12 or any other suitable heating source.

The gas can be provided to chamber 10 through a gas entrance 62. Gas entrance 62 can be in the form of a nozzle or other suitable structure. In various embodiments, the gas can be heated by various methods, such as with a heat source associated with a gas entrance or gas source (not shown). Gas entrance 62 can be located at a position around chamber 10 that allows gas to be provided generally to chamber 10; for example, it can be located near orifice plate 14. According to various embodiments of the applicants' teachings, the gas is allowed to randomize within chamber 10 in order to form gas flow streams. The lower pressure of MS chamber 40 relative to chamber 10 establishes a gas draw through orifice plate aperture 38. Because of the gas draw, a portion of the gas within chamber 10 will be generally drawn through orifice plate aperture 38, via, in certain configurations, heated laminar flow chamber 12. The gas flows at least partially out through boundary member aperture 26 and at least partially toward inlet 42 and then toward orifice plate aperture 38. In addition to the components shown in FIG. 1, at least one heat source (not shown) can be provided outside of chamber 10, such as a heat source associated with a sample source for providing heat to the sample, and/or at least one heat source can be located inside chamber 10. For example, a heat source located within chamber 10 can comprise a laminar tube.

Referring still to FIG. 1, a second sample source 46 is shown. Second sample source 46 can comprises second sample emitter 48, which can emit a second sample. A second sample inlet 50 can be defined in chamber 10. Second sample inlet 50 can comprise one or more apertures defined by boundary member 18, or other locations around chamber 10 such that the second sample can be introduced to chamber 10. According to various embodiments of applicants' teachings, second sample source 46 can comprise means for introducing the second sample to chamber 10. The means for introducing the second sample can be, but not limited to, a nozzle or tube, or other introduction means as known in the art. Second sample source 46 can be of the same as sample source 20, or different. For example, second sample source 46 can include any ion spray device, a corona discharge needle, a plasma ion source, an electron impact or chemical ionization source, a photo ionization source, an atmospheric pressure (AP) MALDI source, a DESI source, a DART source, a thermal desorption source, a SONIC spray, Turbo V™ source, or any multiple combination of the above. Other types of ions sources can be used, and the ion source may operate at atmospheric pressure, above atmospheric pressure, near atmospheric pressure, or in vacuum. In accordance with the applicants' teachings, it will be understood by those skilled in the art that the boundary member can enclose a mobility analyzer and that the sampling inlet can interface with a mobility analyzer. In addition, second sample emitter 48 can include a nebulizer assembly (not shown) to blow uncharged and/or charged sample into chamber 10 for subsequent desolvation and ionization within chamber 10 or further downstream in the mass spectrometer. Sample source 20 and second sample source 46 can be connected to the same power supply, or can be connected to two different power supplies. In various embodiments, one power supply is used and suitable means to control the voltage of each ion source separately is provided. Further, although some of the figures show the second sample source in a parallel configuration with the first sample source, this need not be the case. The second sample source can be in any orientation as long as the sample can be introduced into chamber 10.

The samples can comprise molecules, such as neutral molecules or ions. The ions of the second sample can be of the same or opposite polarity as the ions emitted by sample emitter 28.

According to various embodiments of applicants' teachings, chamber 10 can be configured so that it is possible that there can be more than one second sample introduced to chamber 10. For example, chamber 10 can define a first aperture for the introduction of a first sample, and can define at least one other aperture for the introduction of at least a second sample, meaning at least one other sample. For example, chamber 10 can define in total, 2, 3, 4, or more apertures for the introduction of 2, 3, 4, or more samples.

In various embodiments, sample source 20 can be associated with an electromagnetic field. As is understood by those with skill in the art, during operation of an ion source, such as an electrospray ion source, for example, a potential voltage can be applied to the ion source in order for it to produce ions. Electromagnetic fields can be associated with most ion sources, some directly in forming the ions, some to direct ions after they are formed. In the case of electrospray sources, the strength of the electromagnetic field is dependent on the applied potentials and spacings as well as geometries. The distance from which the electromagnetic field can be detected depends on various factors, such as the geometry of the ion emitter. Electromagnetic field interactions between two ion sources can have the effect of providing instability and signal reduction due to ion beam deflection or changes in the rate of ion generation. It is evident that electromagnetic field interactions are minimal, or essentially non-existent, when a potential applied to a second sample source has, for example, minimal effect on the stability, intensity, or tuning of the first sample source. Also, a close association to sample source 20 can have a detrimental effect on the analysis of the first sample as a result of gas flow interactions resulting from the introduction of one or more samples. Any of these effects could have a detrimental effect on the analysis of the first sample.

Having a second sample source can have geometric constraints as well. Certain sample sources, such as a MALDI plate (see FIG. 3, described below), have dimensions that do not allow a second sample source to be situated in close proximity, and the geometric constraints do not allow the second sample to be located in close proximity to a sampling inlet.

According to various embodiments of applicants' teachings, the second sample source 46 can be sufficiently distant from sample source 20 such that there is minimal detrimental effect on the analysis of the first sample. For example, the distance between the any two sample sources can be in the range of about 3 millimeters to over 20 cm, or in the range of about 1 centimeter to about 10 cm. The configuration of the interface and the sample sources used can determine the optimal distance between any two sample sources. For example, when a 4000 QTRAP® mass spectrometer is employed where a first sample source comprises a nanospray tip and a second sample source comprises electrospray apparatus, a suitable distance between the two sample sources can be in the range of, for example, about 2 centimeters to about 7 centimeters, or in the range of about 3 centimeters to about 6 centimeters, or in the range of about 4 centimeters to about 5 centimeters. For example, a suitable distance between the two sample sources can be about 4.5 centimeters.

In the embodiment shown in FIG. 1, second sample emitter 48 can emit a second sample into chamber 10 at a position from inlet 42 such that the second sample is not transmitted directly to inlet 42 (and subsequently orifice plate aperture 38). For example, using a configuration such as that shown in FIG. 1, the second sample can be substantially drawn to inlet 42 with the assistance of the gas flow streams established by the gas in chamber 10. In this manner, the gas flow stream established within chamber 10 that is directed to inlet 42 and/or aperture 38 acts generally as a conduit for transport of the second sample to sampling region 24 and subsequently to inlet 42 and orifice plate aperture 38 to allow and/or significantly improve sampling of the second sample. The establishment of the gas flow stream allows multiple sample sources to be positioned sufficiently far apart to reduce or eliminate the detrimental effects of field and/or gas flow interactions or any other interaction, as needed. In various embodiments, boundary member 18 and heated laminar flow chamber 12 can be electrically connected such that they can establish a field-free, or near field-free, region within chamber 10 in the absence of external electromagnetic fields associated with the ion sources. Under these conditions, the gas flow streams can more effectively act to carry ions to inlet 42/orifice plate aperture 38. In the applicants' teachings, it will be understood that field-free conditions can include field-free conditions or near field-free conditions.

Figure 2:
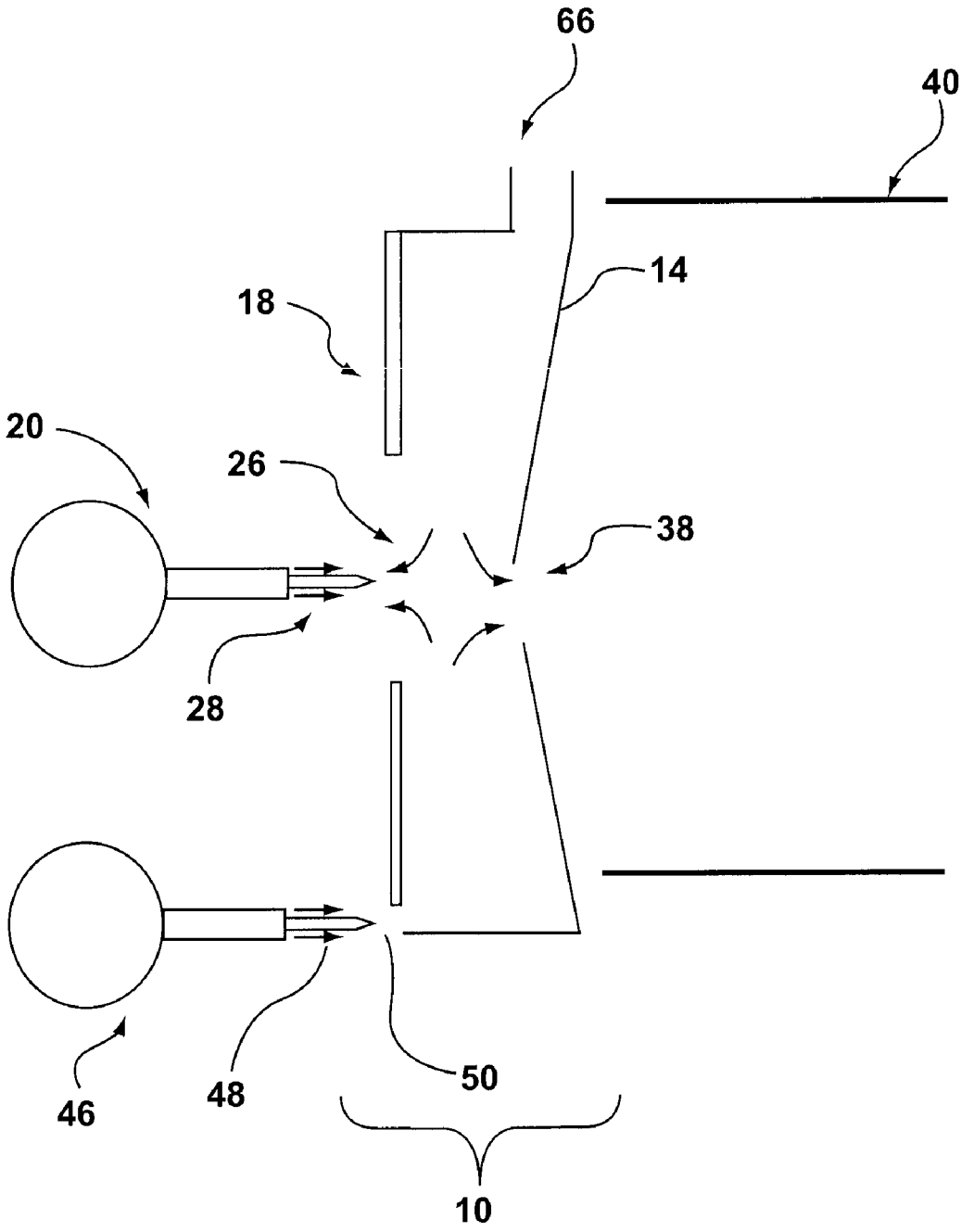
FIG. 2 shows a schematic diagram of an embodiment of a different chamber suitable for use in implementing the applicants' teachings.

FIG. 2 illustrates various embodiments of the applicants' teachings in which a different interface configuration is provided. In this configuration, chamber 10 as shown is used. Chamber 10 comprises orifice plate 14, which defines orifice plate aperture 38, and boundary member 18, which defines aperture 26. A sample can enter a mass spectrometer chamber 40 (completely enclosed chamber 40 not shown). Chamber 10 is at least partially defined by boundary member 18 and orifice plate 14. Gas can be provided to chamber 10 through gas inlet 66. Boundary member 18 and orifice plate 14 can be electrically connected to establish an essentially field-free, or near field-free, region between them in the absence of electromagnetic fields associated with sample sources/sample emitters. In this configuration, sample source 20 comprising sample emitter 28 is shown proximate, or adjacent, to aperture 26. An additional sample source 46 comprising second sample emitter 48 can be located in a position sufficiently distant from the aperture 26. Additional apertures can be defined in boundary member 18 or other regions of chamber 10 to allow additional sample to enter chamber 10. As described above, various ion sources, including electrospray ion sources, are suitable for implementing the applicants' teachings. In addition, the orifice plate aperture 38 can be replaced by any other sampling inlet device known, such as capillary inlets, ion pipes, or heated capillaries.

Figure 3:
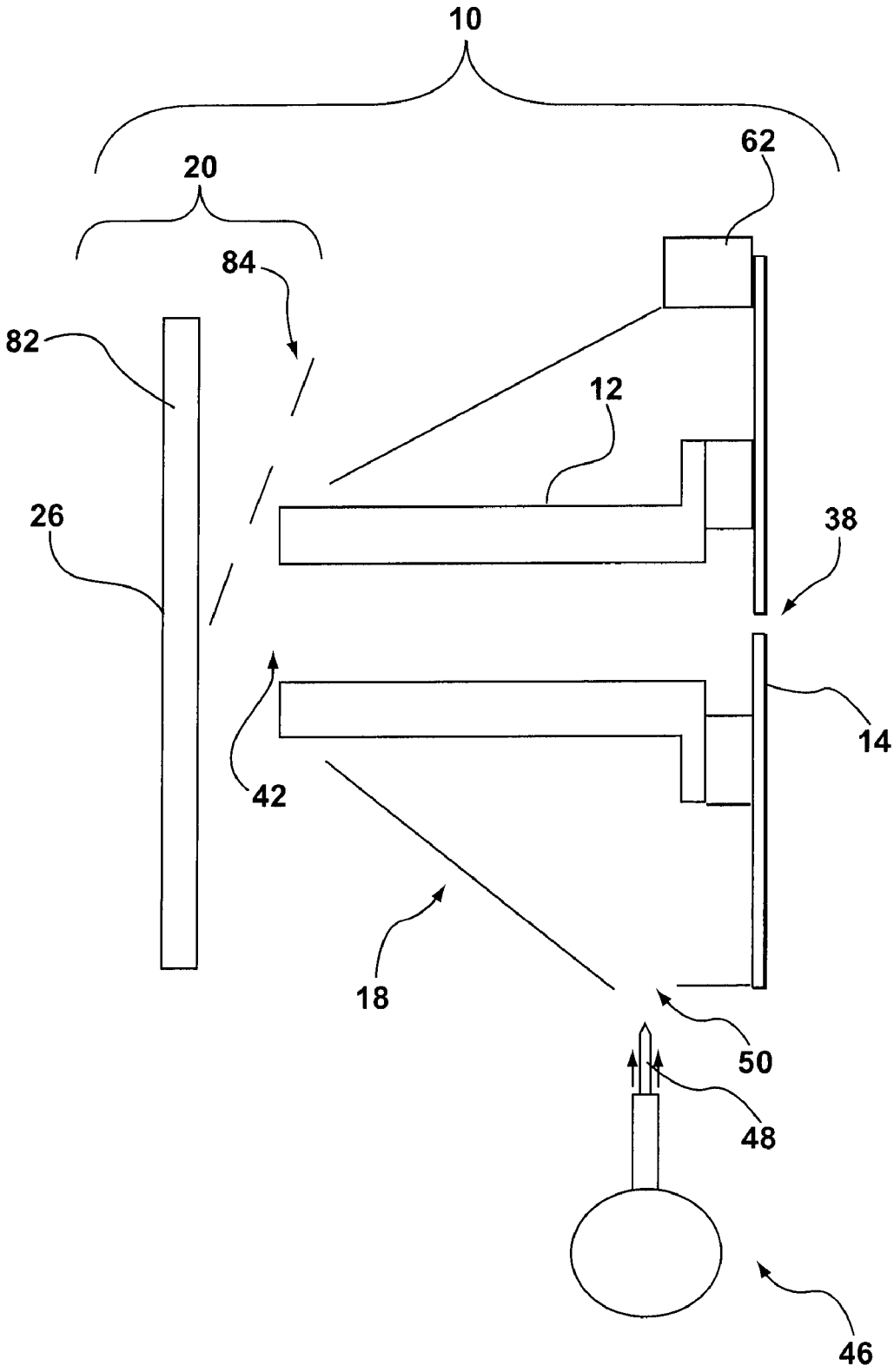
FIG. 3 shows a schematic diagram of an embodiment of a different chamber suitable for use in implementing the applicants' teachings.

FIG. 3 illustrates various embodiments of the applicants' teachings in which a different interface configuration is provided. In this embodiment, sample source 20 comprises a plate 82 and laser irradiation 84, such as a MALDI system, and sample can be generated by laser irradiation 84 of samples on the plate 82. As will be understood by those skilled in the art, samples can optionally be mixed with one or more matrices to facilitate sufficient ionization. Alternatively, samples can be desorbed as neutrals for subsequent ionization by other means generally known. The plate can present a geometrical constraint on the location at which second sample source 46 comprising second sample emitter 48 is located. FIG. 3 shows the boundary member 18 establishing the chamber 10 with primary aperture 26 proximal to heated chamber 12. Aperture 26 can be established flushed with, upstream, or downstream of inlet 42 in heated chamber 12 provided that the gas flow establish by port 62 can carry molecules from second source 46 to inlet 42.

Figure 4:
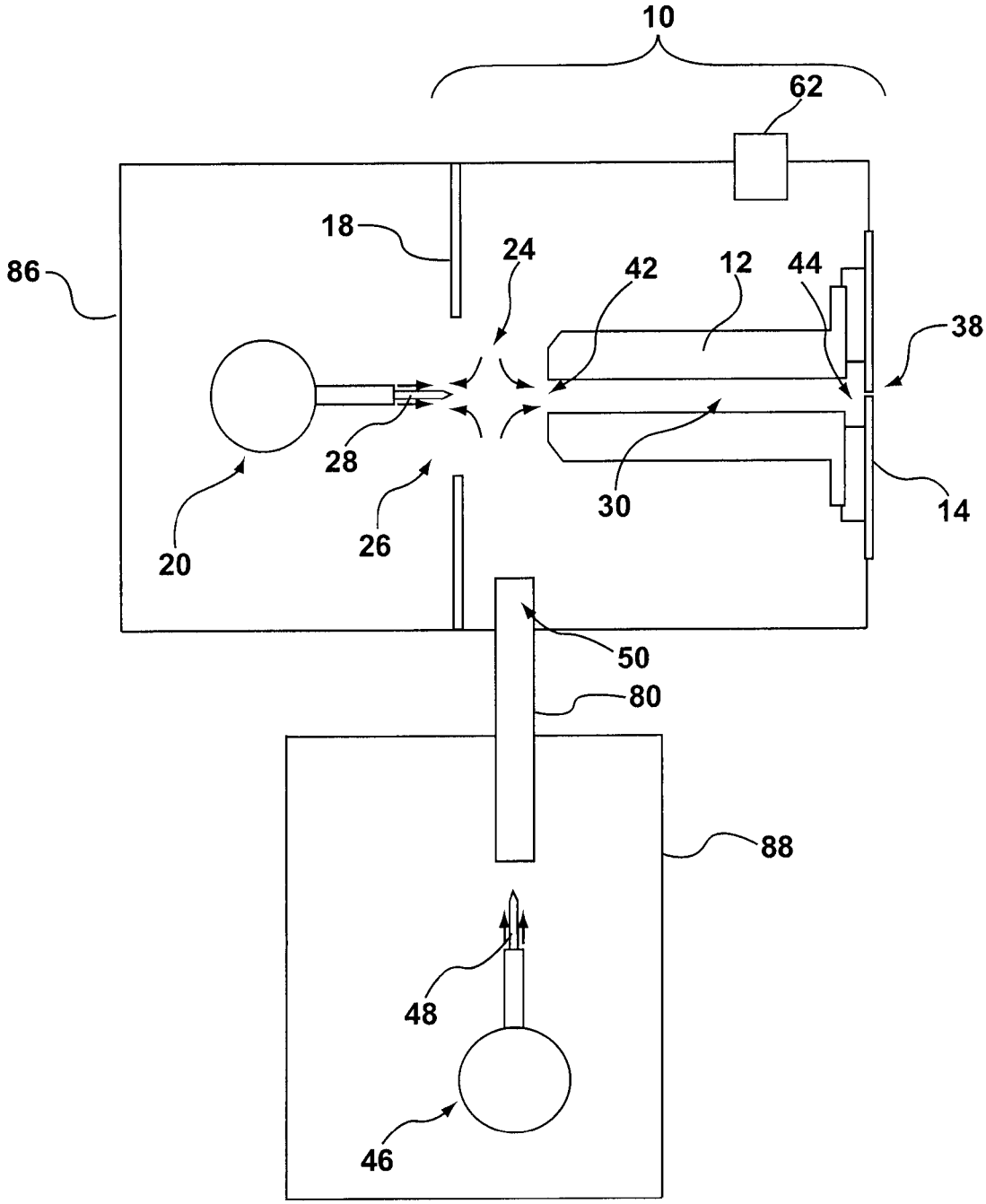
FIG. 4 shows a schematic diagram of an embodiment of a different chamber suitable for use in implementing the applicants' teachings.

FIG. 4 illustrates various embodiments of the applicants' teachings in which a different interface configuration is provided. In this embodiment, second ion source is not located adjacent or proximate to inlet 50. Second sample is introduced to chamber 10 through, or with assistance from, channel member 80. Channel member 80 can be a tube, although it need not be rounded, nor must it be rectilinear, or other structure that allows the transport of the sample to chamber 10. According to various embodiments, a gas source can be employed to introduce gas into channel member 80 in order to assist the transport of sample to chamber 10. It will be understood from the applicants' teachings that more than one sample source can introduce more than one sample to chamber 10 using the embodiment shown in FIG. 4, or in combination with any of the other embodiments disclosed herein. It will also be apparent that the geometry of channel member 80 and source 46 can be changed without deviating from source principles, for example, the sample can be introduced at different location along the channel member 80.

In various embodiments, as shown in FIG. 4, the first source 20 can be enclosed in a first source housing 86 and the other source 46 can be enclosed in a corresponding second source housing 88. Alternatively, the other source 46 can comprise of more than one sources so that at least one other source 46 can each be enclosed in the same or individual corresponding source housing 88.

The various embodiments described above can permit ions or molecules from one or more additional sample sources to be delivered to a chamber upstream from a mass spectrometer inlet. For example, in the case of ions, they can be sampled into the instrument simultaneously with ions from a first sample source, or the sampling of ions from the various sample sources may be gated to achieve indexing. In the case of neutral molecules, the neutral molecules can be combined with the ion stream from the first sample source or a sample stream from another sample source and subsequently ionized by gas phase charge transfer or other ionization processes.

According to various embodiments of the applicants' teachings, methods of indexing the introduction of ions into a mass spectrometer and devices therefore are provided. The introduction of a first sample to chamber 10 upstream from aperture 38 can be associated with a first electromagnetic field, such that when the first sample is introduced, it can pass through aperture 38 for analysis by the mass spectrometer. At least a second sample of ionized molecules, or neutral molecules that will become ionized, introduced to chamber 10 by a second or more sample source can be substantially repelled by an electromagnetic field associated with introduction of the first sample, and be substantially prevented from passing through aperture 38. The second sample, which can be used as calibrant, essentially remains in chamber 10. The introduction of the second sample can be associated with a second electromagnetic field. The second electromagnetic field can be sufficiently remote from the first electromagnetic field such that the second electromagnetic field does not have a detrimental effect on the analysis of the sample by the mass spectrometer. When the first electromagnetic field is removed so that the first sample is no longer introduced into chamber 10, the second sample is able to pass through aperture 38. The first electromagnetic field can subsequently be re-established to once again introduce the first sample. This method provides a method of introducing a second sample to a mass spectrometer separately from the first sample in a manner that allows the samples to be indexed. Such indexing of samples can allow for external calibration of the mass spectrometer.

According to various embodiments of the applicants' teachings, a method for introducing sample to a mass spectrometer from at least two sources is provided. The method can comprise introducing a first sample to chamber 10 at an entrance point upstream from orifice plate aperture 38 of a mass spectrometer, the first sample being introduced substantially adjacent to orifice plate aperture 38 and introducing at least one other sample to chamber 10 at a position not adjacent to orifice plate aperture 38. Chamber 10 can further define gas entrance 62 for allowing the introduction of a gas into chamber 10, such that a gas flow stream is established in which gas flows partially generally toward the entrance point of the first sample and partially toward the sampling inlet. In various embodiments, the introduction of the first sample is associated with an electromagnetic field and the introduction of the at least one other sample is sufficiently remote from the introduction of the first sample such that the introduction of the at least one other sample does not have a detrimental effect on the analysis of the first sample by the mass spectrometer.

In order to gate the mass spectral analysis of a first sample and at least one other sample various methods and devices as known in the art currently, and suitable methods and devices that will subsequently be developed, can be used. For example, samples can be gated by controlling one or more ion source electromagnetic fields. Other gating methods and devices comprise mechanical, electrical, or pneumatic means, for example. Mechanical means can comprise, for example, blocking the introduction of at least one of the samples into chamber 10. This can be achieved by using, for example, one or more beam chopping lenses, or physically moving one or more emitters off axis and away from its aperture. Electrical means can comprise, for example, reducing or halting power to at least one of the sample sources. Pneumatic means can comprise, for example, controlling the flow of an additional gas source for blowing additional gas, such as a high velocity gas stream, towards one or both of the samples such that that sample is substantially prevented from reaching the sampling inlet. Other gating methods and devices comprise fluid selectors, in which the flow of sample to an emitter is rapidly turned on and off. Hydraulic valves and/or solenoid valves, for example, can be used to do this. Other methods and devices comprise spray controllers, which operate by enabling and disabling the sample emission at the emitter tip. This is usually controlled by electric fields, although mechanical and pneumatic means are also possible. Indexing can be achieved by control of the electrospray potential. Electrical indexing of emitters can also be achieved by using lenses located within the chamber proximal to the tip of each emitter. Other methods and devices comprise rotating the emitters from their respective aperture, or rotating the apertures, so that the sample is prevented from entering the chamber. Other methods and devices comprise ion-beam selectors which are located within the chamber and gate one or more samples in either partial or deep vacuum. In addition, electrodes can be added to the chamber to apply an extraction potential that diverts sample from the sampling inlet. Furthermore, gating can comprise controlling the ion delivery from one or more ion sources to provide sample separately or simultaneously to at least one or more other sources.

Figure 5:
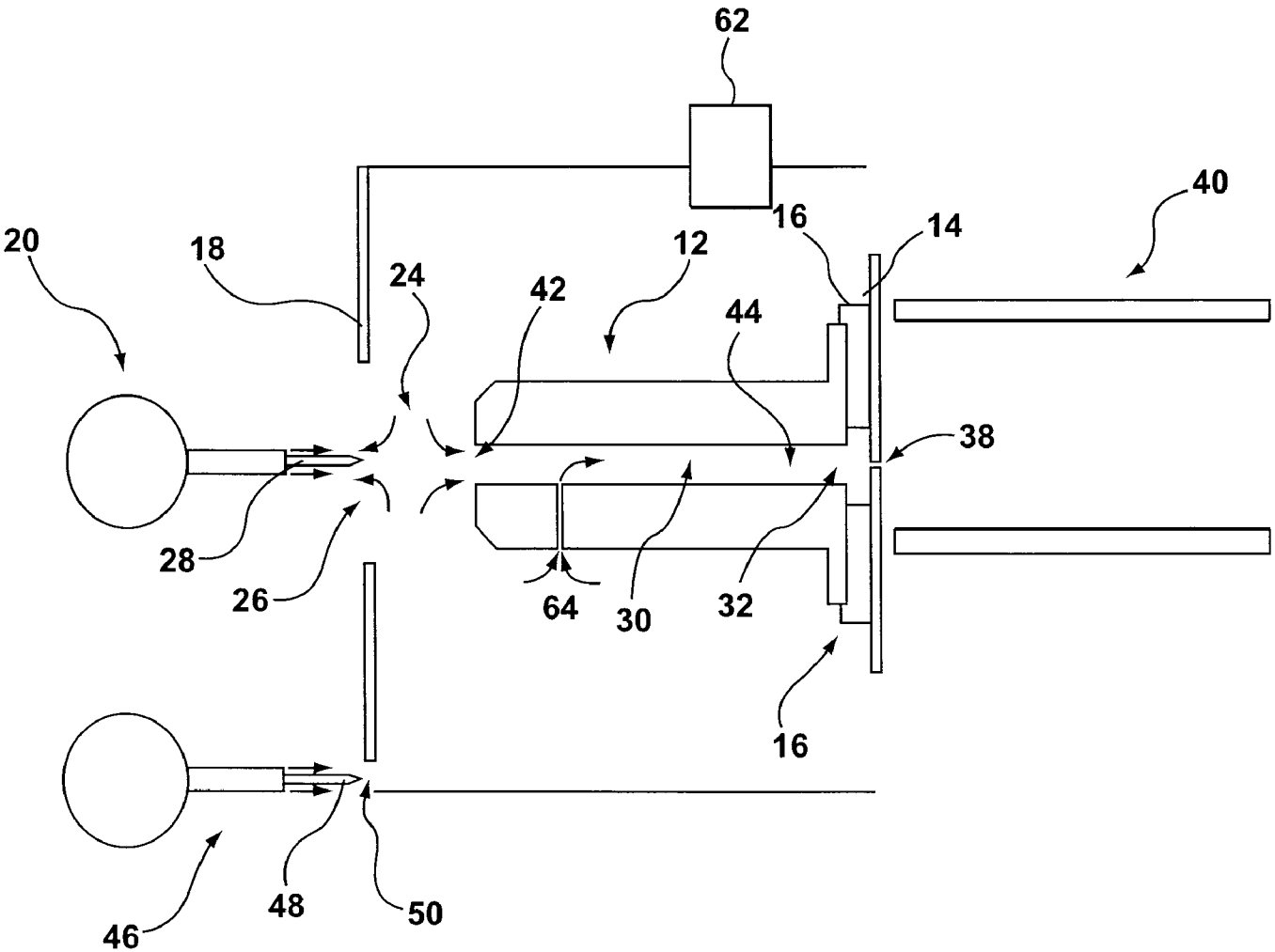
FIG. 5 shows a schematic diagram of a chamber, in accordance with various embodiments of the applicants' teachings, suitable for use in implementing the applicants' teachings.

FIG. 5 demonstrates various embodiments of applicants' teachings. An additional channel 64 is shown defined by and extending radially through heated laminar flow chamber 12. Multiple flow streams are mixed within heated laminar flow chamber 12 to generate a single stream through space 32 and orifice aperture 38. Additional channel 64 provides an inlet which can function as an additional inlet within chamber 10 such that the at least one other sample can be sampled into the instrument at about the same time as the first sample. In this fashion, multiple separate ion streams could be sampled simultaneously. Such a system allows, for example, internal calibration of the instrument. In various embodiments of the applicants' teachings, multiple sampling inlets are enabled such that the sample from sample source 20 and sample from second sample source 46 are transported into different inlets with subsequent mixing in either the atmospheric pressure or vacuum regions.

The applicants' teachings have been described using additional ion sources for, for example, mass calibrant addition; however, various embodiments of the applicants' teachings can be used for any application where it is useful to supply multiple streams of ions or ions generated by different types of ion sources to the same mass spectrometer. These can include, but are not limited to, generation of different polarity ions for ion-ion reactions, means for supplying neutrals for ion-neutral reactions, droplet-droplet mixing experiments, charge inversion experiments, internal and external calibration, etc. For example, in accordance with the applicants' teachings, a first source can comprise a charged spray and at least one other source can comprise a neutral spray or an oppositely charged spray to that of the first source. The sprays from the first and at least one other source can be mixed together to conduct ion-ion or ion-neutral reactions. Neutrals can be charged and polarity can be inverted.

There are other aspects of a mass spectrometer that are not necessarily shown or described herein, such as, for example, additional lenses, power supplies, vacuum pumps, etc. but would be understood by the skilled person to either be required or useful for using a mass spectrometer. In addition, the terms used herein are defined by their function, and can be referred to with different names by other skilled persons. For example, chamber 10 as herein described can be referred to as, in certain circumstances, an atmospheric pressure interface, or in the same or different circumstances, as a curtain chamber, and may or may not have all of the features presently described for chamber 10. Examples of currently-available MS devices within which the applicants' teachings can be advantageously applied include quadrupole (triple quadrupole and single quadrupole), TOF (including QqTOF), and ion trap mass spectrometers. In general, any MS device in which the use of a second or more ion source is suitable for use in implementing the applicants' teachings.

Aspects of the applicants' teachings may be further understood in light of the following examples, which should not be construed as limiting the scope of the applicants' teachings in any way.

Example 1

Figure 6:
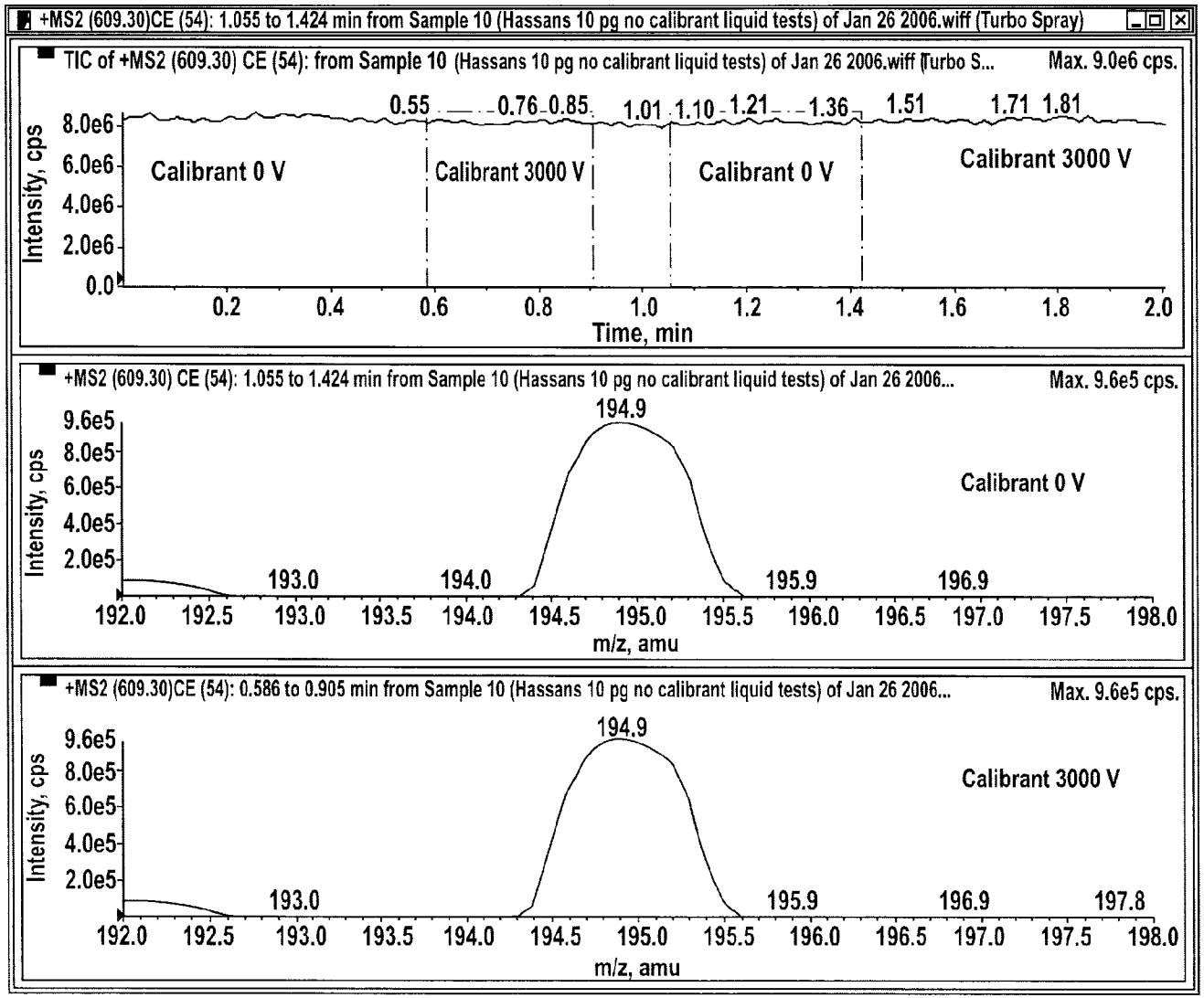
FIG. 6 shows a mass spectrum showing the lack of emitter field effects resulting from the applicants' teachings.

As described above, ion source performance can be hindered by electric field interaction when another sample source, such as an ion source, is located in close proximity (see, for example, Rulison and Flagan, Rev. Sci. Instrum., 1993, 64, 683-686, which is hereby incorporated by reference). FIG. 6 demonstrates the results of experiments designed to verify elimination of ion source field effects in accordance with the applicants' teachings. For the data presented in FIG. 6, a sample of reserpine was nanosprayed through a first sample emitter while solvent was electrosprayed through a second sample emitter located distant to a heated laminar flow tube inlet. The signal for protonated reserpine fragment ions was monitored as the potential applied to the second sample source was varied. As demonstrated in FIG. 6, the signal generated from the first sample source was not affected by the electromagnetic field associated with the second sample source, demonstrating a lack of detrimental field effects. The distance between the two sample sources was approximately 3 centimeters. In addition, since the first ion source emits sample proximal to the inlet, and the aperture in the boundary member is concentric with the inlet, there is no signal reduction compared to a standard configuration (second source and second curtain plate aperture removed).

Example 2

Figure 7:
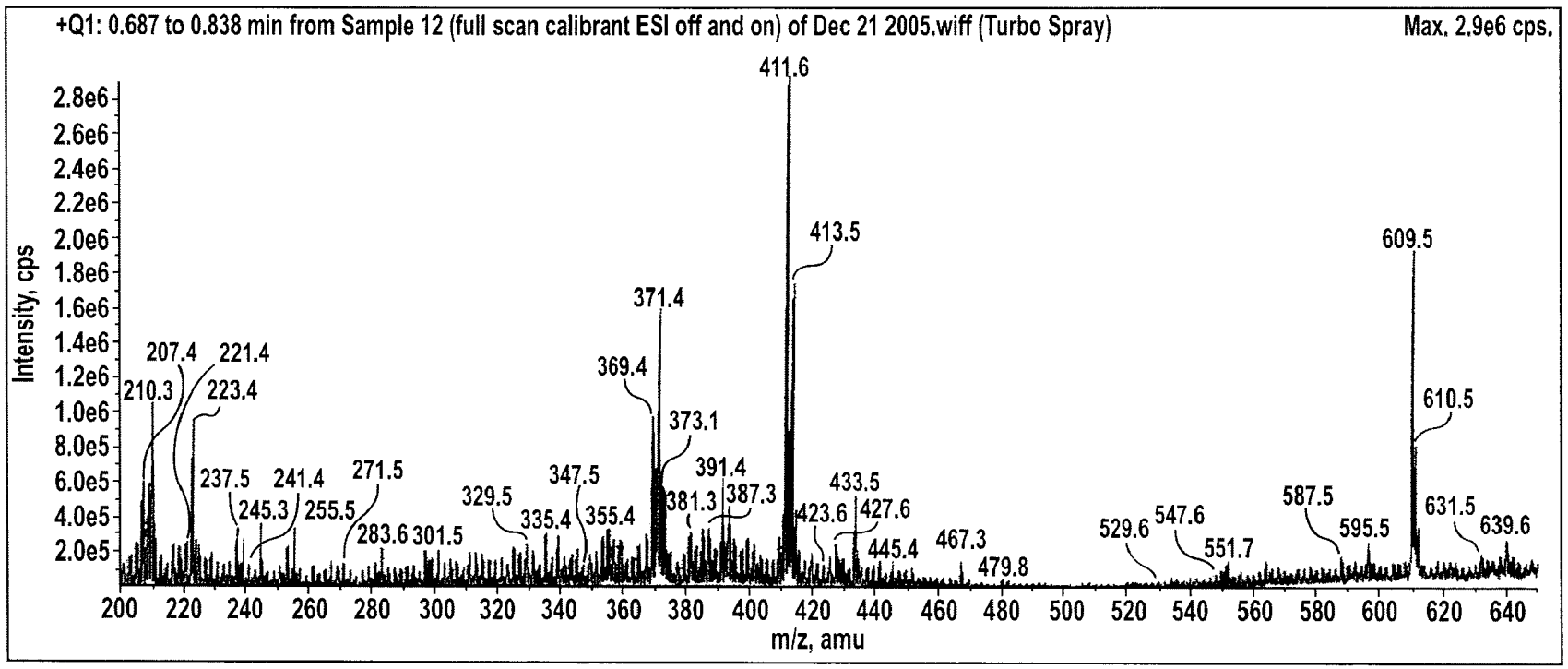
FIG. 7 shows a mass spectrum showing the presence of calibrant ions produced according to the methods of the applicants' teachings.

This experiment was conducted using a configuration similar to that shown in FIG. 1. Neutral species introduced to a chamber by a sample source can undergo gas phase charge transfer when exposed to ions introduced by a first sample source, which is sometimes referred to as an analytical flow stream, resulting in the presence of ionized species that can act as mass calibrant ions in the analytical mass spectrum as shown in FIG. 7. FIG. 7 shows data acquired for a sample of minoxidil sprayed through a nanospray tip of the first sample source with introduction of neutral reserpine molecules into the atmospheric pressure region. In this case, the second sample source comprised a nebulizer assembly, and no potential was applied to the nebulizer. The nebulizer flow rate was set sufficiently high to nebulize solvent generated at the tip into the chamber. The solvent flow rate was approximately 5 microL/min. The first sample source included a nanoflow electrospray source spraying minoxidil at approximately 500 mL/min. The spectrum shows the protonated minoxidil ion (m/z 210) as well as a protonated reserpine ion (m/z 609) within the same spectrum, as well as a number of higher intensity phthalate peaks that were present in the solvent provided to the analytical sprayer of the first sample source. The reserpine ion was formed by gas phase charge transfer from the ion stream formed by the first sample source. Indexing was achieved by stopping the nebulizer gas flow to the nanospray tip to prevent molecule penetration from the second source into the chamber. With this mode of operation, calibrants and ions from the nanospray tip are present within a single mass spectrum. In this manner, it can be possible to achieve internal mass calibration for nanospray experiments or experiments with other types of sources.

Figure 8:
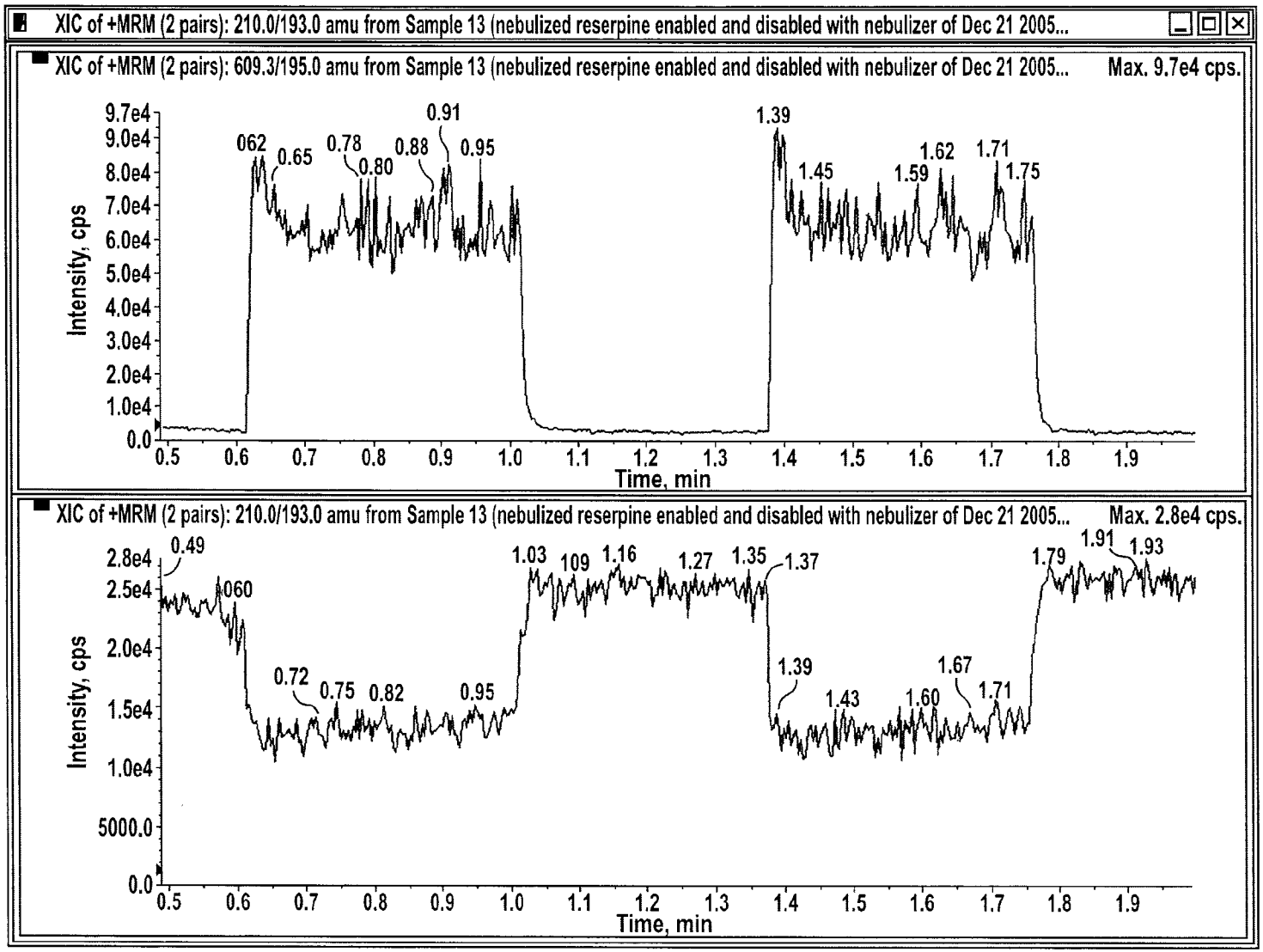
FIG. 8 shows MRM traces produced according to methods of the applicants' teachings.

Charging of neutral calibrant molecules can result in a net loss of charge on ions of interest as a result of gas phase charge transfer as shown in FIG. 8. For the data collected in FIG. 8, a sample of minoxidil was electrosprayed through a nanospray tip and a sample of reserpine (calibrant) was nebulized through a second sprayer assembly. Data were collected in the multiple reaction monitoring (MRM) mode of operation and traces for reserpine and minoxidil are displayed in the top and bottom panes of FIG. 8, respectively. The MRM dwell times were 100 ms each with 2800 V applied to the ion emitter for minoxidil and a nebulizer setting of 20 for the second emitter assembly. The initial settings for the second sprayer were 0 V for the ESI potential and 0 for the nebulizer gas setting. Initially, the MRM trace displayed approximately 25000 counts per second (cps) for minoxidil fragments. At approximately 0.6 min, the nebulizer for the second ion emitter was turned on with a setting of 55 (about 3 to 3.5 L/minute), thereby nebulizing the neutral calibrant droplets into the chamber through a 2 mm calibrant inlet near the periphery of the curtain plate. For this experiment, the heated laminar flow chamber was maintained at 200° C., giving a curtain gas temperature of approximately 100° C. Desolvation of the nebulized calibrant droplets led to the formation of gas phase neutral reserpine molecules. Gas phase charge transfer resulted in signal for protonated reserpine ions within approximately 500 ms. The substantial increase in intensity for reserpine ions was accompanied by a decrease in intensity for minoxidil ions, presumably a negative result of gas phase charge transfer to the calibrant. At approximately the 1 minute mark, the second ion emitter nebulizer was turned off. The signal for reserpine ions decreased back to the initial background level over the course of the next 1-2 s. The time required to remove the calibrant signal is a result of the time necessary to drain residual pressure on the second nanospray tip nebulizer supply lines, as well as the time necessary to sweep the neutral calibrants from the atmospheric pressure region. FIG. 8 demonstrates that neutral ionization as a result of the analytical sprayer (first sample source) plume can impact the signal for the analytical sample (approximately a factor of 2 for these data).

Example 3

Figure 9:
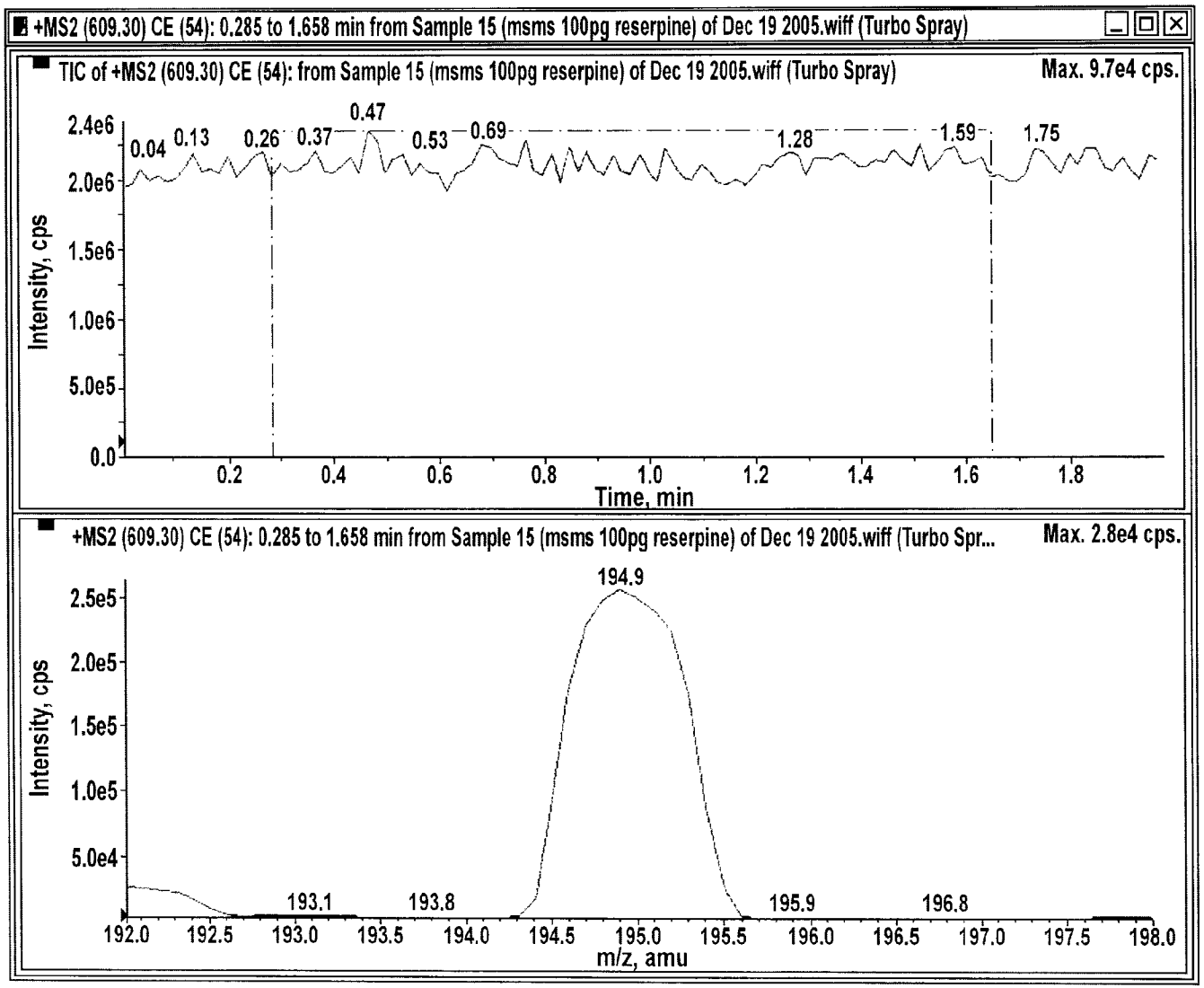
FIG. 9 shows tandem mass spectral data for reserpine using an emitter according to methods of the applicants' teachings.

Another method to achieve mass calibration involves the addition of charged calibrant ions to an atmospheric pressure region, or ionization of neutral calibrant molecules within an atmospheric pressure region at a position sufficiently distant from a first sample emitter. Assuming that the atmospheric pressure region is essentially field free (e.g. 500 V on curtain plate and 500 V on heated chamber similar to that shown in FIG. 1), ions can also be carried within the curtain gas flow to the heated laminar flow chamber inlet for sampling. An example of this is shown in FIG. 9, where a 100 pg/microL sample of reserpine was infused (1 μL/min) through a second nanospray tip located at the periphery of the curtain plate. The ESI potential was 3000 V and the nebulizer was set to 55 (about 3-3.5 L/min). For these data, the first nanospray tip was removed to substantially ensure a field free configuration proximal to the inlet. As shown in FIG. 7, a substantial MS/MS signal (the signal was down by approximately 50-times relative to a standard optimized configuration on the same system due to the distance from the inlet and the non-concentric nature of the boundary member aperture and the inlet) was generated for this sample, even though the second ion emitter infused charged species into the atmospheric pressure region at a position far removed from the inlet. The signal was generated because of the combined effects of the atmospheric pressure region and curtain gas flow (i.e. this signal would not have been possible if atmospheric pressure region and curtain gas flow were removed. Therefore, FIG. 9 shows that seeding ions into the atmospheric pressure region and using the curtain gas flow to carry them to the inlet can be a viable approach for calibration. Improved signal for calibrant ions can tend to be achieved using a configuration similar to that shown in FIG. 4 where calibrants are nebulized through a channel member, such as a tube, to the sampling inlet.

Example 4

Figure 10:
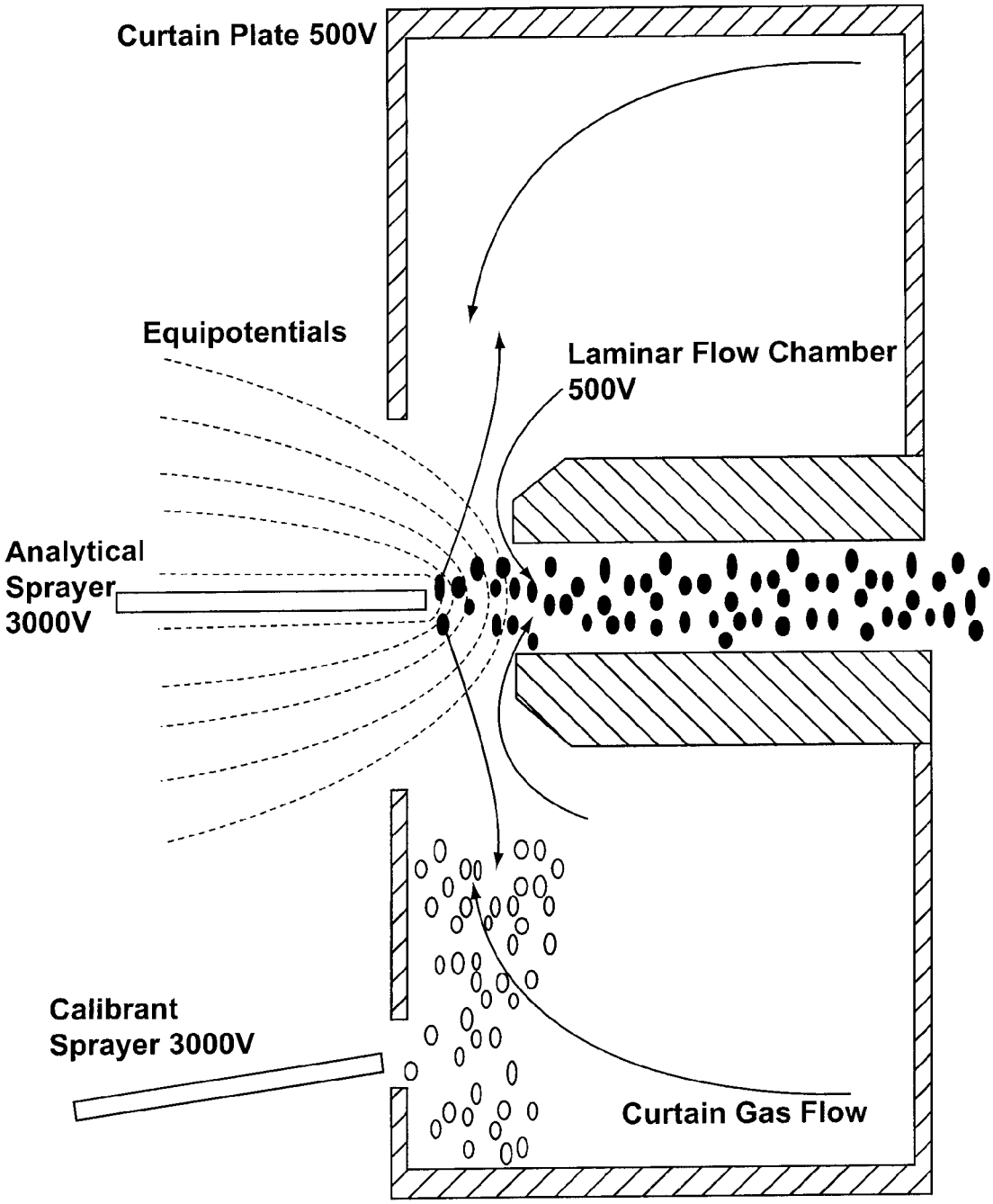
FIG. 10 shows a schematic diagram showing an ion emitter adjacent to a boundary member aperture that is coaxial to an inlet with an electric field according to various embodiments of the applicants' teachings.

Electric field penetration can create a potential barrier that may extract charged particles from the curtain gas flow, depending on the relative strength of the gas flow and electric field. FIG. 10 graphically shows equipotentials (dotted lines) in the vicinity of heated laminar flow chamber inlet when a first ion emitter is a nanoflow ESI sprayer and is located approximately flush with a first curtain plate aperture. This can also be achieved by fabricating a channel into the back or inside of the curtain plate such that the calibrant ions are carried by the nebulizer gas flow through the essentially field-free structure created by the channel. In operation, a first ion emitter operates with an electrical potential of approximately 3000 V. While this has no effect on neutral calibrants, it will repel positively charged ions from the inlet. In addition, the charged droplet stream generated from the first ion emitter also repels ions that are present in the curtain gas flow.

Figure 11:
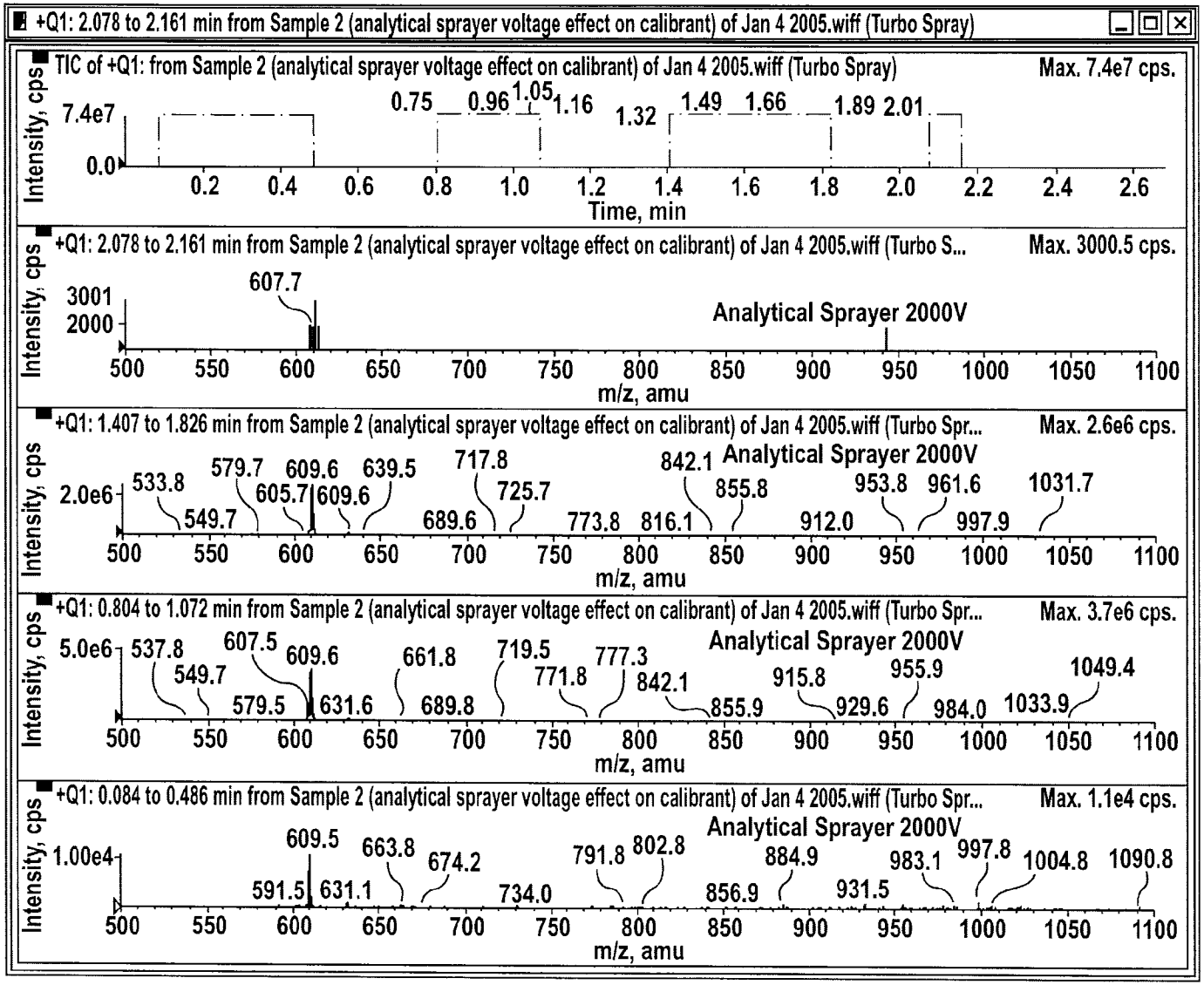
FIG. 11 shows mass spectral data showing calibrant signal as the nanospray tip potential increases using a low curtain gas pressure setting.
Figure 12:
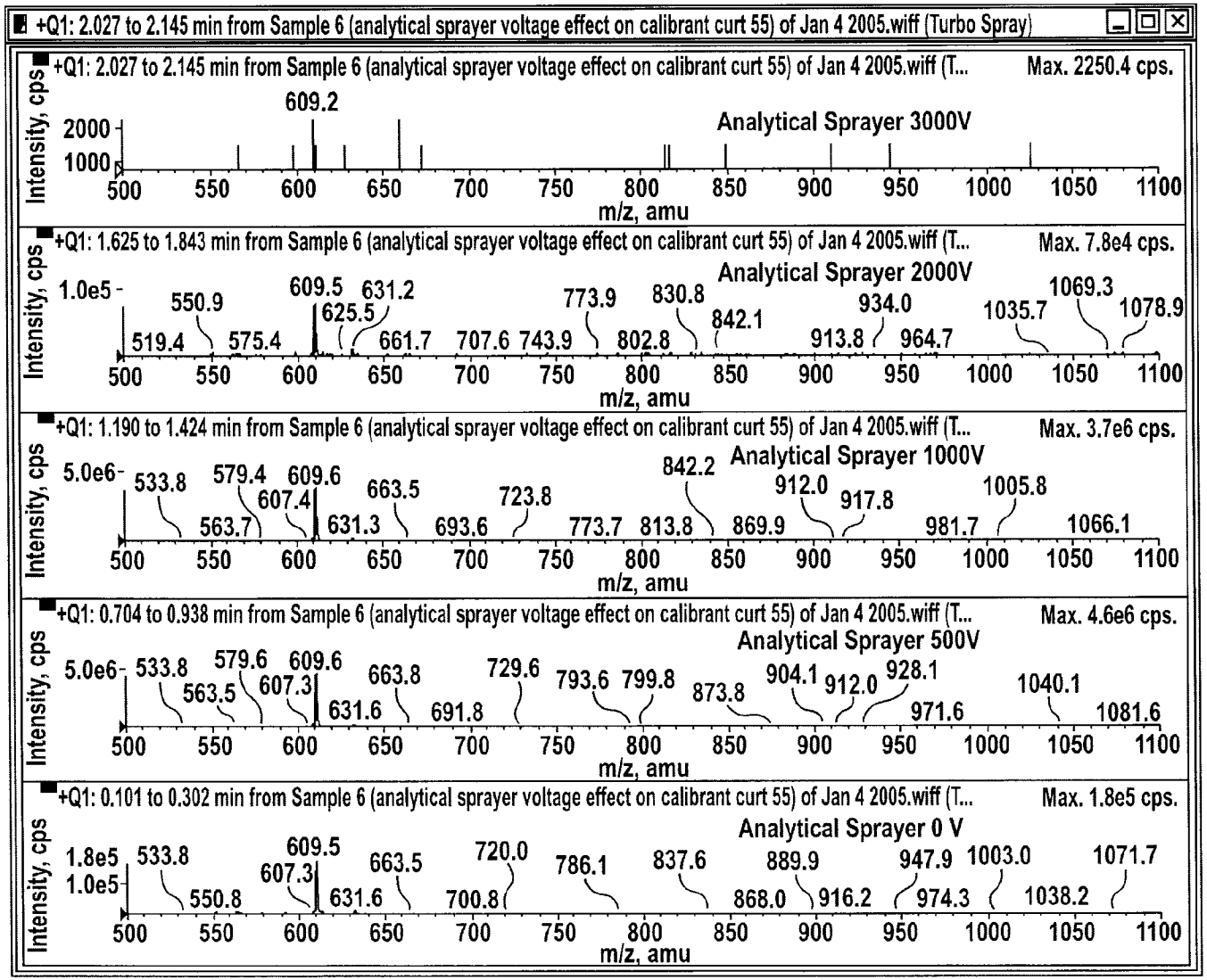
FIG. 12 shows mass spectral results showing calibrant signal as the nanospray tip potential increases using a high curtain gas pressure setting.

Experimental data supporting this are presented in FIGS. 11 and 12. For the data presented in FIGS. 11 and 12, the mass calibrant was comprised of 1000 pg/μL reserpine infused through a small hole in the periphery of the curtain plate (ESI potential 3000 V, nebulizer 55). No solvent flowed through the first ion emitter, however, the first ion emitter was located adjacent to the curtain plate and used a standard nebulizer gas setting (10 in Analyst® software). The analytical sprayer potential varied from 0 V to 3000 V (the standard operating potential is approximately 3000 V with this configuration) for the data in FIG. 11 and 0 V to 3000 V for the data in FIG. 12. Both figures show that the potential of the first ion emitter has a significant impact on ion sampling for the calibrant ions). The electrical forces imparted by the field applied to the analytical sprayer had a much larger effect on the calibrant ions than the pneumatic forces imparted by the nebulizer from the analytical sprayer (data not shown). Using the lowest curtain gas setting (FIG. 11), the signal was almost completely eliminated for reserpine ions when the analytical sprayer potential was set to 2000 V. The signal was completely eliminated with a setting of 3000 V (data not shown). Increasing the curtain gas setting to the maximum (FIG. 12) helped to drive more reserpine ions to the heated laminar flow chamber inlet (more successfully overcoming the field barrier), with a signal of 78000 cps for an analytical sprayer potential of 2000 V. These results help to demonstrate the balance between electrical repulsion and the curtain gas force carrying calibrant ions towards a sampling inlet.

Example 5

Figure 13:
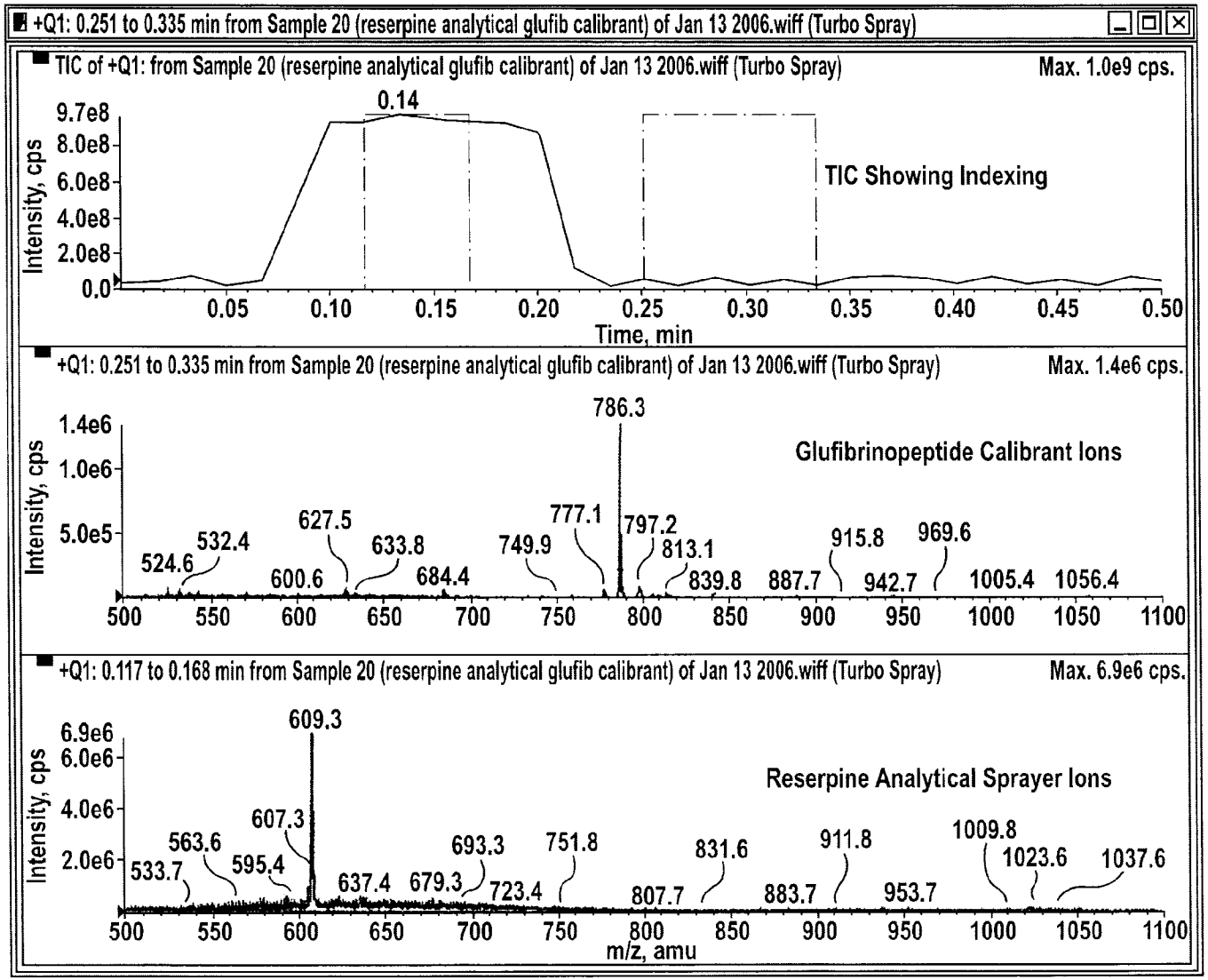
FIG. 13 shows calibrant and analytical signal indexing for doubly charged calibrants according to methods of the applicants' teachings.
Figure 14:
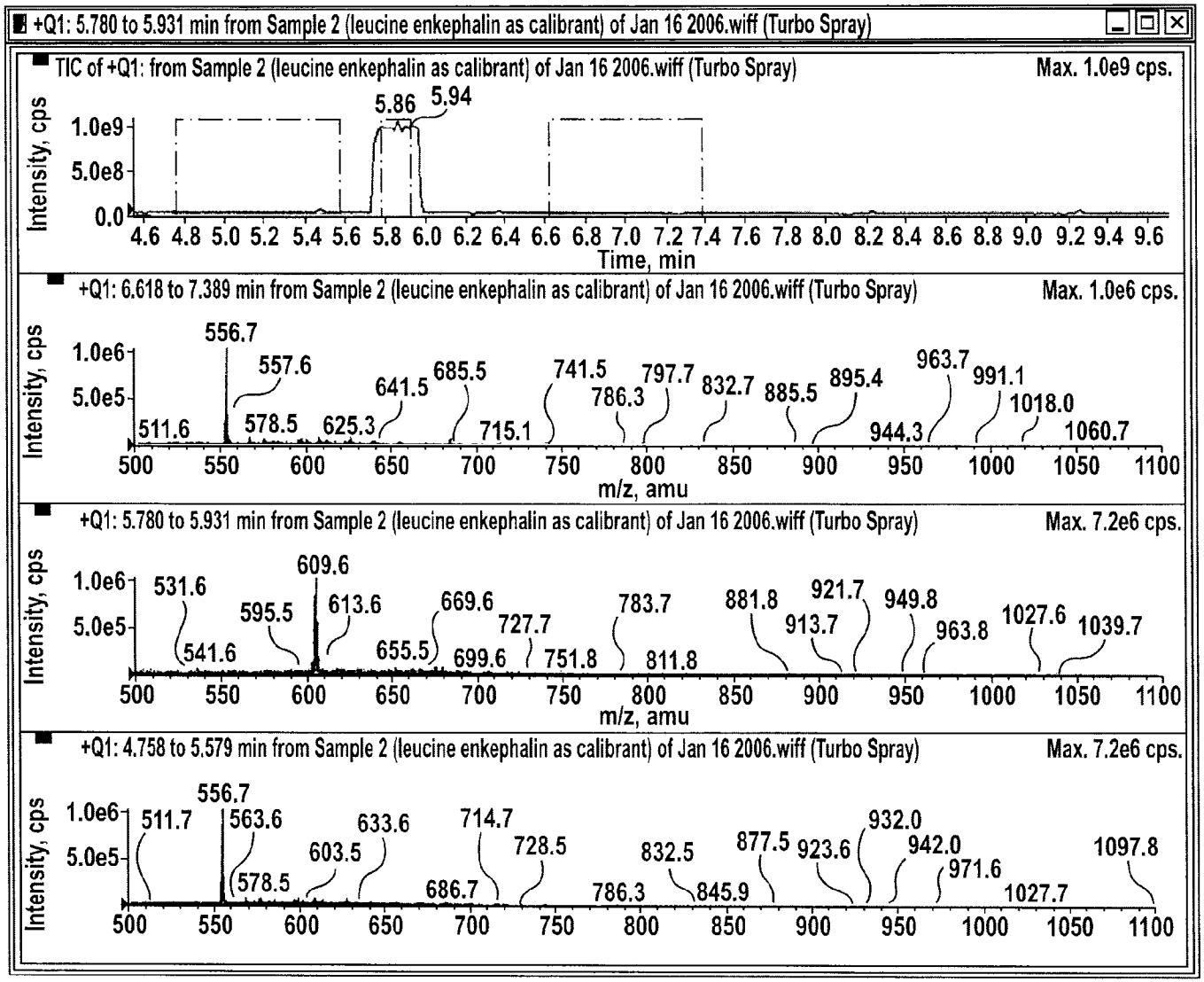
FIG. 14 shows calibrant and analytical signal indexing for singly charged calibrants according to methods of the applicants' teachings.
Figure 15:
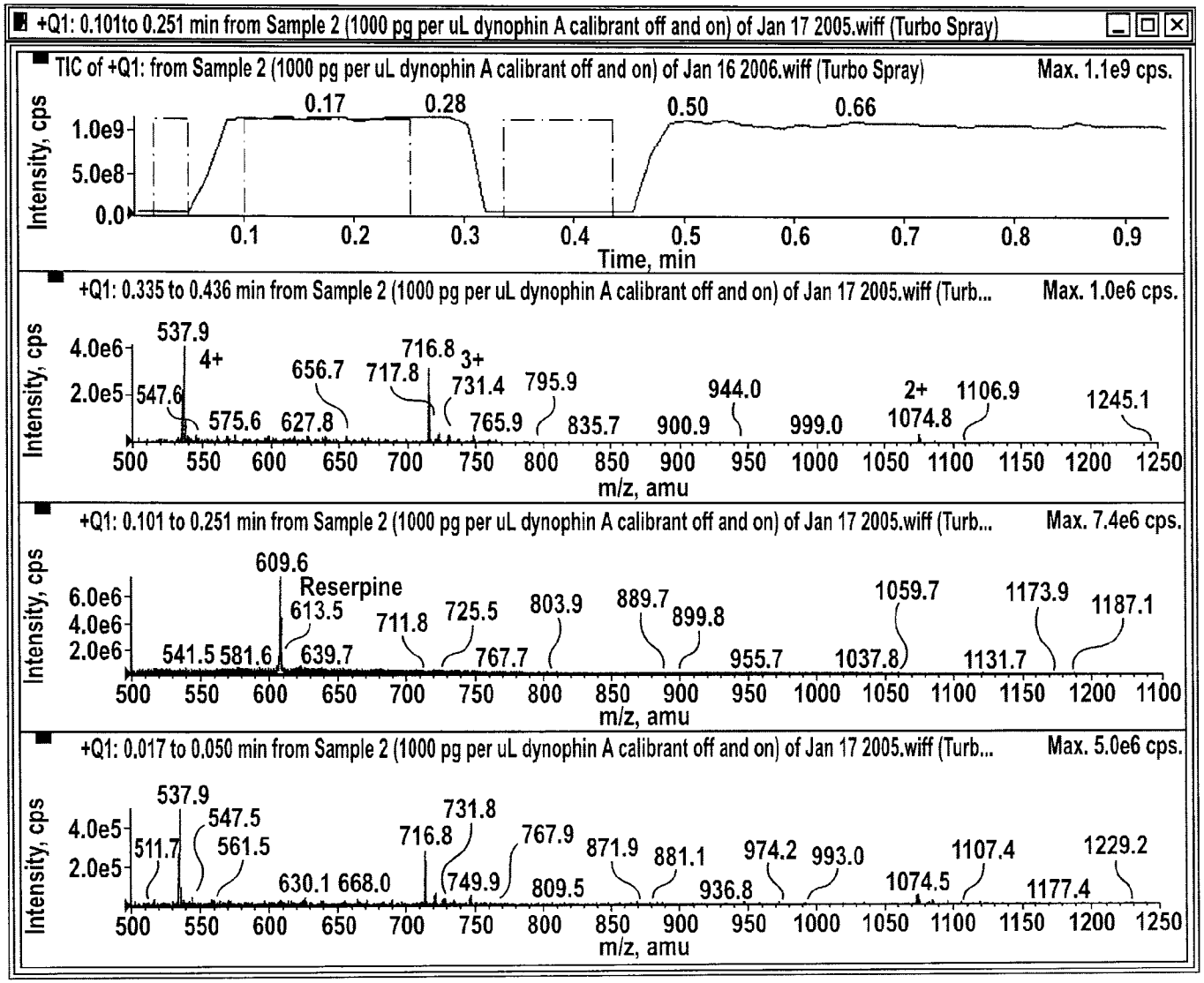
FIG. 15 shows calibrant and analytical signal indexing for a range of charge states according to methods of the applicants' teachings.

The inventors have found that the electrical repulsion produced by a first ion emitter can be even more pronounced when a spray of charged liquid emanates from it. In fact, the competing forces of field repulsion and the presence of a curtain chamber prior to the heated inlet open up the possibility for a new method of calibrant introduction and sprayer indexing as shown in FIG. 13. The data presented in FIG. 13 were generated by electrospraying 10 pg/μL reserpine through the first ion emitter with settings of 2800 V and 10 for the ESI potential and nebulizer gas setting, respectively. A sample of 1000 pg/μL glufibrinopeptide b was electrosprayed into an atmospheric pressure chamber using settings of 3000 V and 55 for the calibrant ESI potential and nebulizer settings, respectively. Initially, the potential on the first ion emitter, was set to 500 V, essentially generating a field-free region near a heated laminar flow chamber inlet. Calibrant ions (glufibrinopeptide b) were drawn into the inlet giving a peak corresponding to the doubly protonated peptide (middle pane). At approximately time 0.07 min, the potential applied to the first ion emitter was increased to approximately 2800 V to generate a stable electrospray. The calibrant ions were repelled by this potential leading to complete elimination of the glufibrinopeptide b peak, and the onset of signal for singly protonated reserpine (bottom pane). Lowering the potential of the first ion emitter again at approximately time 0.21 min eliminated signal for the reserpine ions, and allowed the calibrant ions (doubly protonated glufibrinopeptide b) to once again be carried to the heated laminar flow chamber inlet, resulting in a very clean spectrum for the calibrant ion. FIG. 13 demonstrates a very effective means to achieve indexed calibrant introduction. FIGS. 14 and 15 show additional examples where the calibrant ions are singly charged (FIG. 14; Leucine Enkephalin) and display a range of charge states (FIG. 15; Dynorphin A).

Example 6

Figure 16:
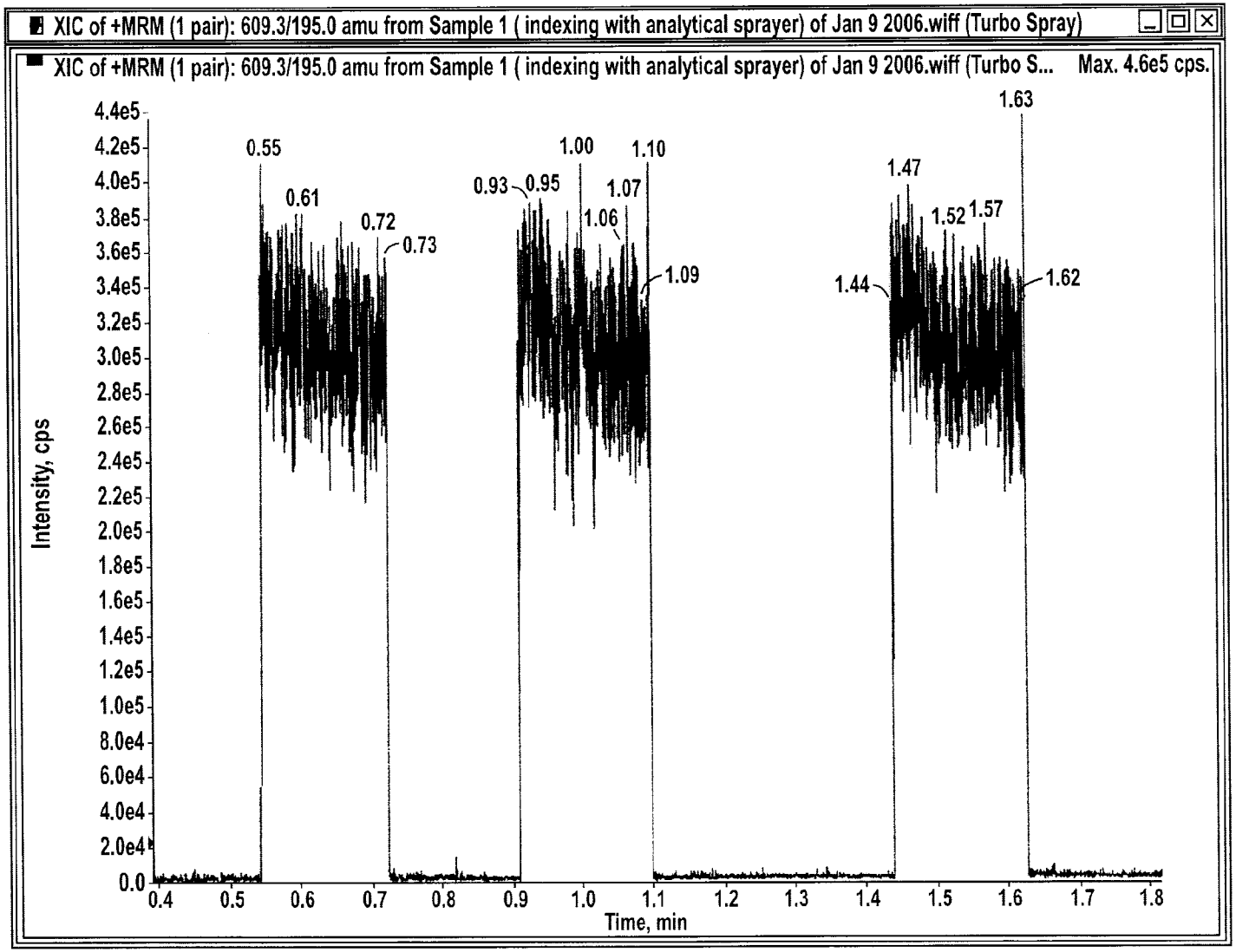
FIG. 16 shows MRM traces showing calibrant indexing with nanospray tip potential.
Figure 17:
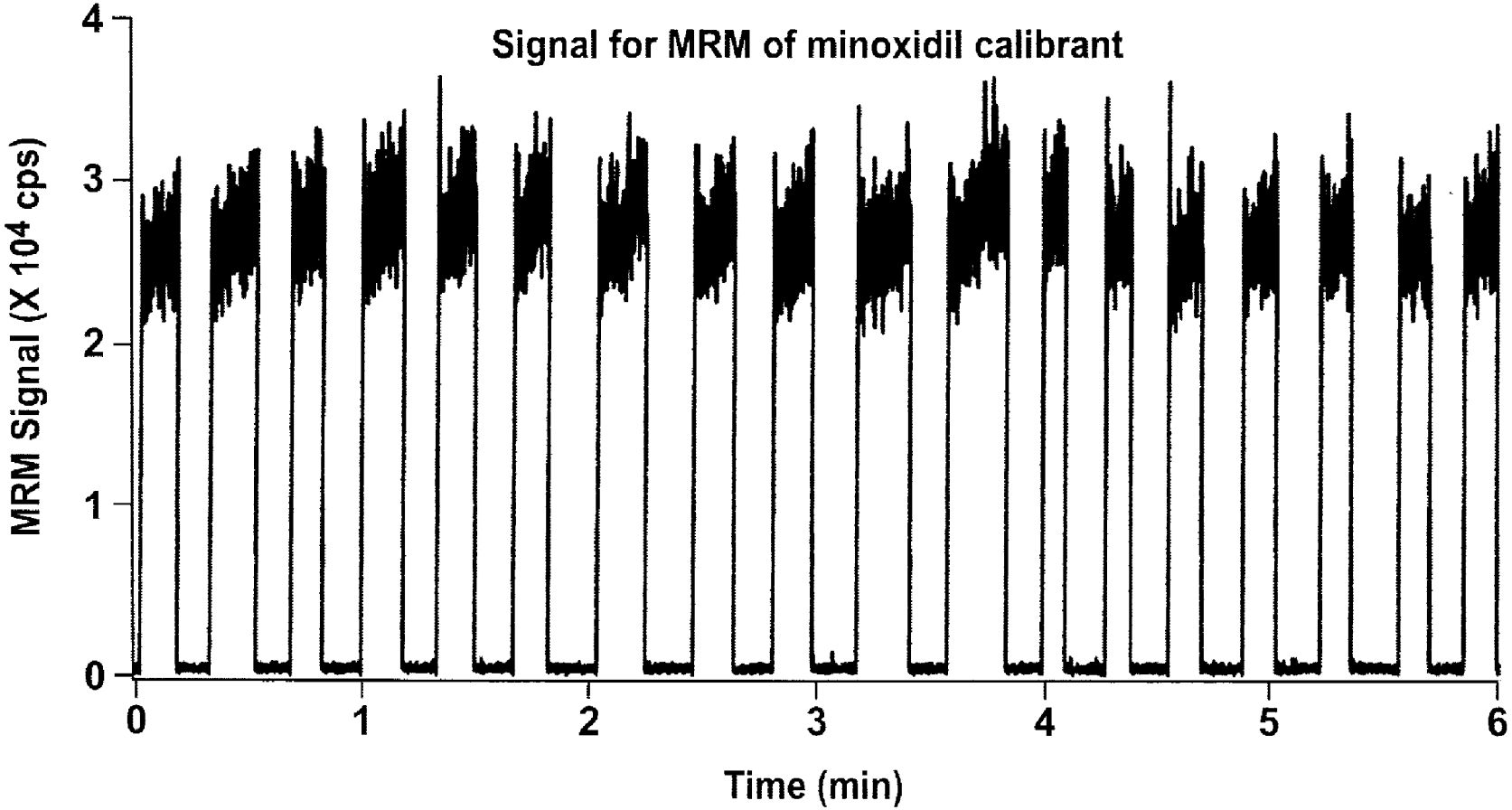
FIG. 17 shows MRM traces showing calibrant indexing reproducibility using nanospray tip potential.

Experiments have also been carried out in MRM mode to determine the speed of enabling or disabling calibrants using this technique as shown in FIG. 16. These data were generated under conditions where a 1000 pg/μL solution of reserpine calibrant ions was sprayed through a second sprayer and solvent was sprayed through a first ion emitter using a 20 ms dwell time for MRM of reserpine calibrant ions. Initially, the potential of the first ion emitter was 2800 V, giving a low residual background due to the analytical spray. At approximately time 0.55 min, the potential of the first ion emitter was lowered to 500 V to give a field-free region for the heated laminar flow chamber inlet. The onset time for signal for reserpine calibrant ions was 44 ms. Increasing the potential of the first ion emitter to 2800 V to re-enable the analytical flow stream eliminated the calibrant signal within approximately 34 ms. Enabling and disabling was repeated 3 times, giving enabling times of 43±2 ms and disabling times of 34±4 ms. FIG. 17 shows additional data demonstrating reproducibility of enabling and disabling using a sample containing minoxidil calibrant ions. The system used for collection of these data can provide an improved high performance nanoflow mass calibration system for suitable mass spectrometers.

Example 7

Figure 18:
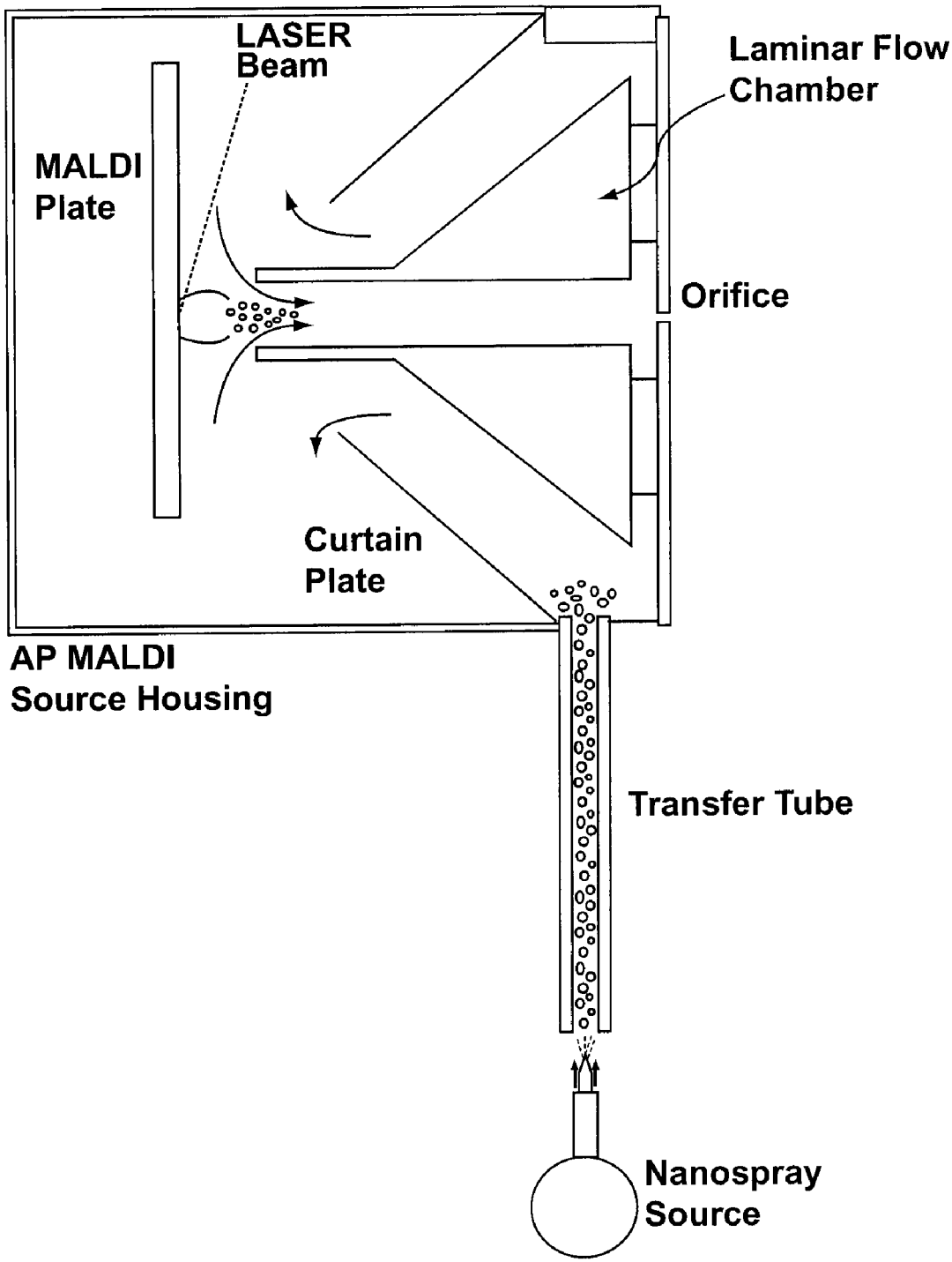
FIG. 18 shows components of an exemplary mass spectrometer in accordance with the applicants' teachings.

This experiment was conducted using a configuration similar to that shown in FIG. 18 using an atmospheric pressure MALDI source and a nebulizer assisted nanoflow electrospray emitter (MicroIonSpray II). It will be apparent to those of ordinary skill in the relevant arts that certain additional components such as source housings, translation stages for the MALDI source, laser optics, and power supplies have been omitted from FIG. 18 for clarity. FIG. 18 shows an orifice plate with an orifice separating the atmospheric pressure source region from the vacuum system of the mass spectrometer. A heated laminar flow chamber is sealed to the orifice with a Teflon spacer, similar to the configuration described in FIG. 1, however, the heated laminar flow chamber has a different shape and length (≈3 cm). A boundary member 18, labeled as a curtain plate forms a chamber with a gas port for introduction of a first gas flow into the chamber. The sampling inlet of the laminar flow chamber protrudes outwards from the aperture in the curtain plate such that the gas flow established in the chamber is directed outwards through the curtain plate aperture, towards the sampling inlet. The MALDI sample plate is located approximately 3 mm from the inlet of the heated laminar flow chamber to effectively sample the plume of ions and neutrals generated from the surface of the MALDI plate under conditions of laser irradiation. An additional nebulizer assisted electrospray emitter is shown at a position substantially removed from the sampling inlet. A 7 cm metal tube (labeled Transfer Tube) is threaded into the curtain plate and has approximately a 2.4 mm channel therethrough to transportions and charged droplets from the nebulizer assisted electrospray source into the chamber established by the curtain plate. In addition to the electrospray potential applied to the nebulizer assisted sprayer, an additional nebulizer gas can be used to improve transmission of ions and charged droplets into the chamber. Moving the outlet of the transfer tube closer to the sampling inlet also tends to improve transmission of neutral or charged samples from additional sources to the sampling inlet.

Figure 19:
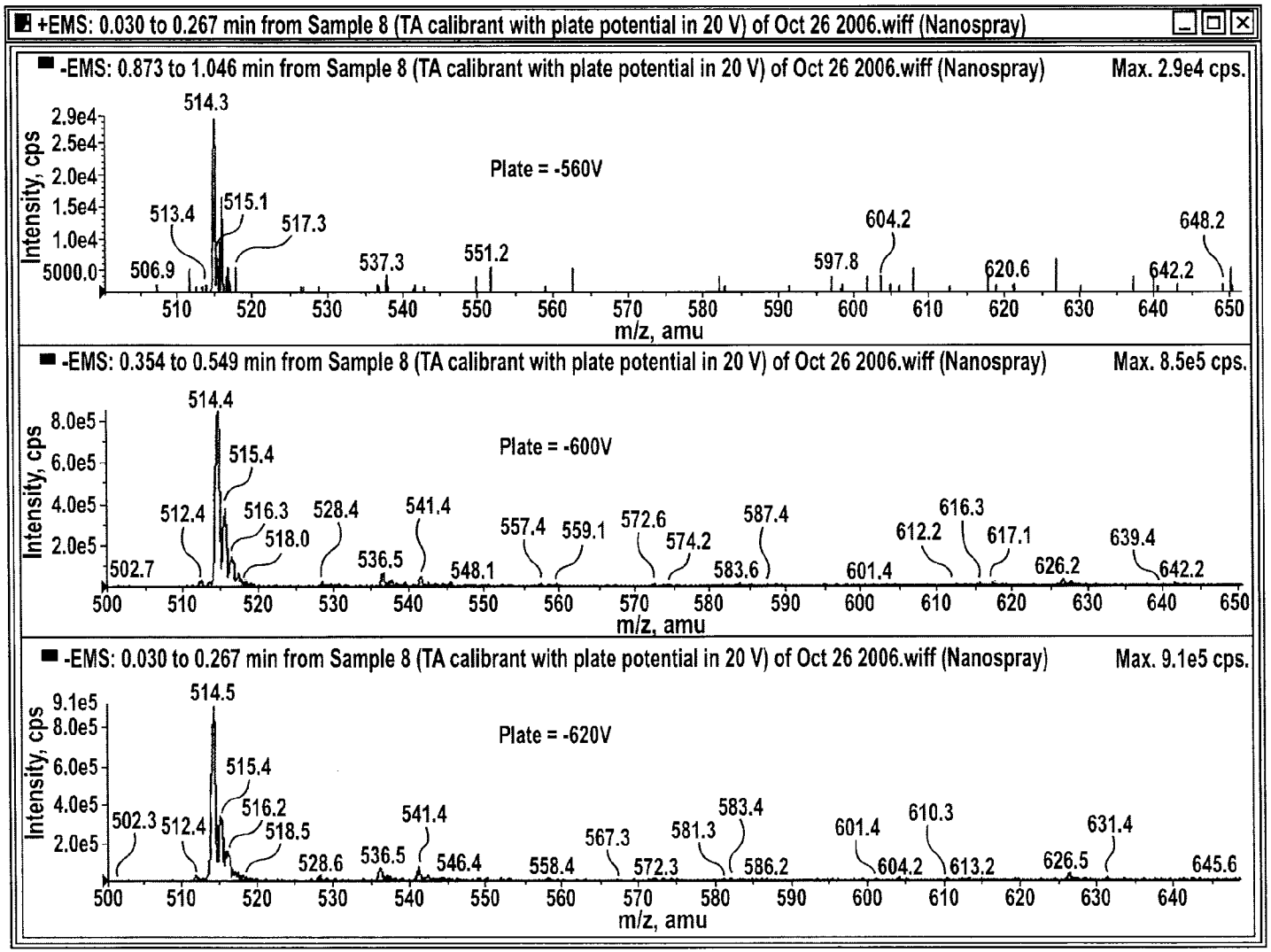
FIG. 19 shows an example of data generated using the mass spectrometer configured in accordance with FIG. 18.

FIG. 19 shows an example of data generated using the configuration illustrated in FIG. 18. A sample of 1000 pg/μL taurocholic acid was electrosprayed at approximately 3 μL/min through a MicroIonSpray II sprayer into the 7 cm long tube using an electrospray potential of −2500 V and a nebulizer gas setting of approximately 3 L/min. The sprayer was pointed directly into the tube so that the nebulizer gas flow could aid in transporting the droplets through the tube. A stainless steel MALDI plate was located approximately 3 mm in front of the inlet of the heated laminar flow chamber (2 mm channel) and the potential was adjusted for the data shown in FIG. 19. The signal generated for calibrant ions was substantially affected by the potential applied to the MALDI target plate. For these data, the curtain plate and heated laminar flow chamber were maintained at −605 V. The potential applied to the MALDI plate was adjusted from −620 V to −600 V to −560 V. In this configuration, where the curtain gas flow emanated approximately 4 mm behind the tip of the sampling inlet, the curtain gas flow past the tip was sufficient to carry ions to the inlet. However, the measured ion current for taurocholic acid ions was influenced by the potential applied to the MALDI plate. Under conditions where the curtain gas emanates farther from the sampling inlet, electric field gradients can be used to supplement the motion of ions towards the sampling inlet.

Figure 20:
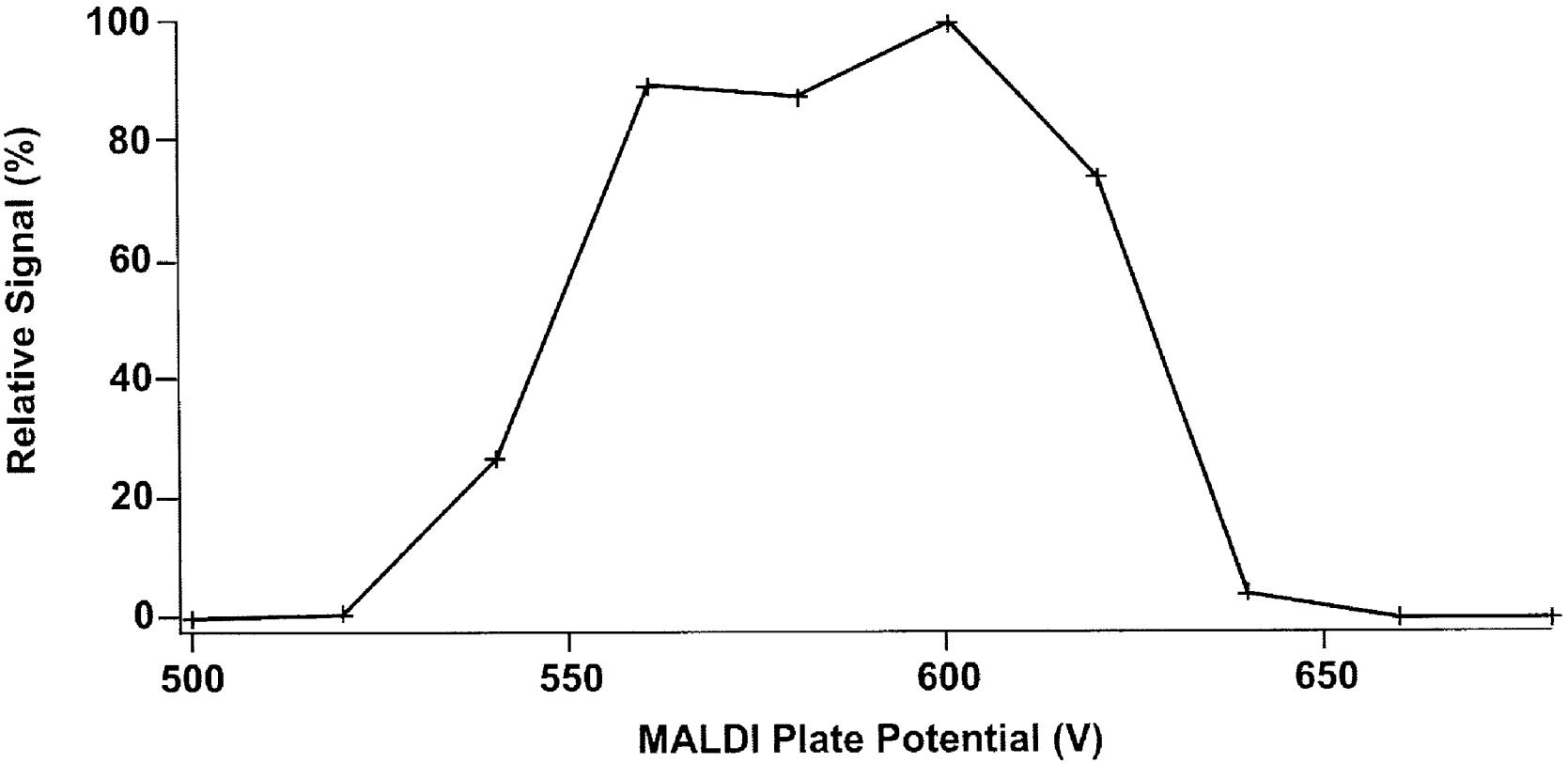
FIG. 20 shows a relationship between MALDI plate potential and signal strength in an analysis in accordance with the applicants' teachings.

FIG. 20 shows the effect of the potential applied to the MALDI plate on the signal for reserpine calibrant ions sprayed through the calibrant sprayer. For this experiment, the potential applied to the curtain plate and inlet was 583 V. The calibrant signal was attenuated very significantly when the MALDI plate potential varied by more than approximately +/−30 V around this value. The width of the optimal target plate potential for sampling calibrant ions varied depending upon the spacing between the plate and inlet as well as the physical dimensions of the plate and the distance that the curtain gas emanated behind the tip of the sampling inlet.

Figure 21:
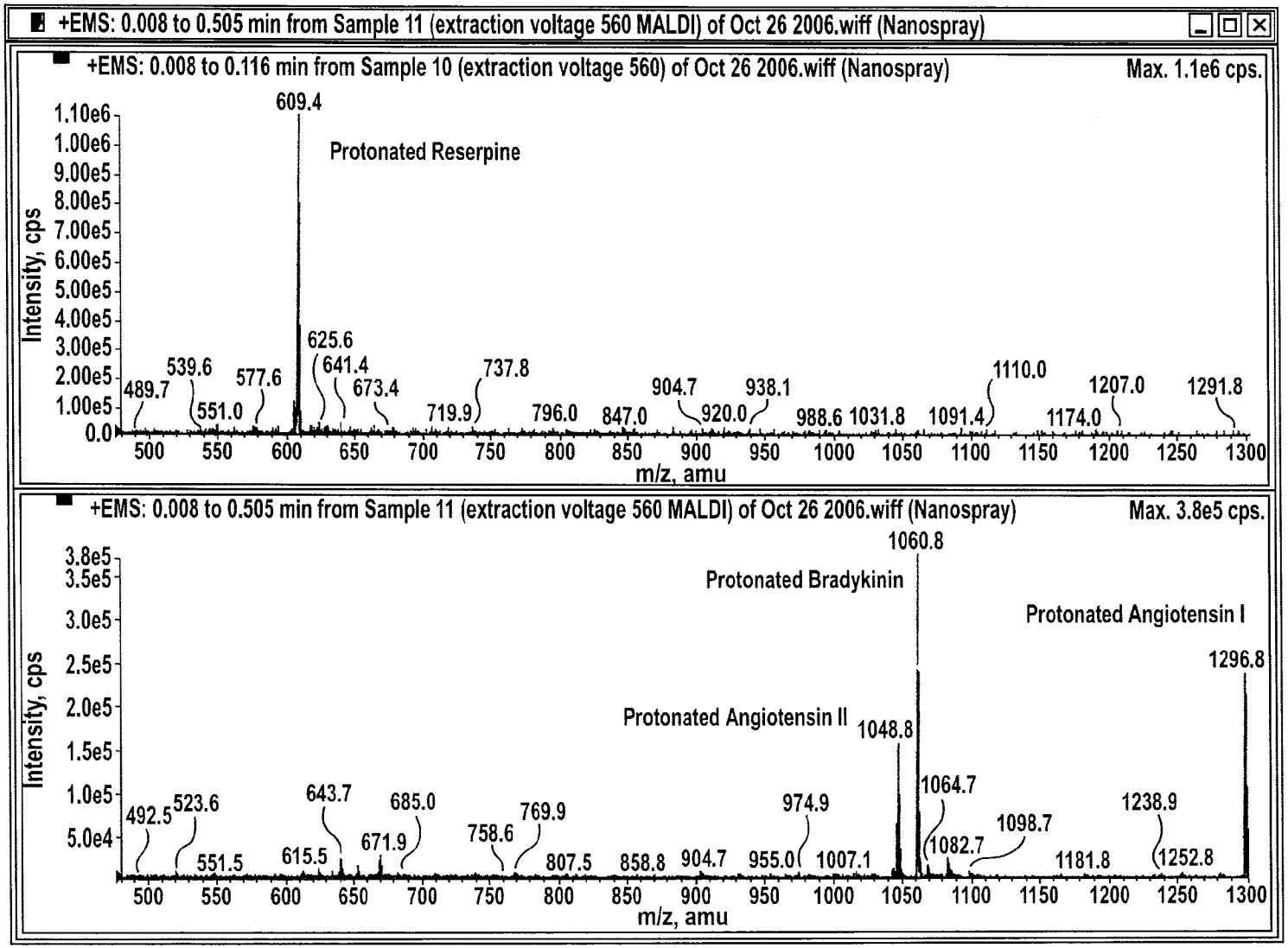
FIG. 21-23 show charge—intensity traces from analyses conducted in accordance with the applicants' teachings.

FIG. 21 shows an example of indexing achieved under conditions where the curtain gas effect is augmented by a small field between the sampling inlet and the MALDI target plate. For the data presented in this figure, a sample containing 3 peptides (angiotensin I, bradykinin, and angiotensin II) was mixed with a suitable MALDI matrix (α-cyano matrix) and deposited onto the surface of the MALDI plate at a concentration of approximately 200 fmol per peptide. A sample of 1000 pg/μL reserpine was electrosprayed through a MicroIonSpray II assembly into the 7 cm long tube throughout the experiment with an electrospray potential of approximately 2500 V and a nebulizer gas flow setting of approximately 3 L/min. The MALDI source was configured to illuminate the sample using a 100 μm optical fiber directing the output from a nitrogen laser onto the surface of the sample. The MALDI plate was rastored so that the laser light was continuously directed onto a fresh sample surface of a deposit from approximately 1 μL of the sample/matrix mixture over the course of this experiment. Initially, the MALDI plate was maintained at approximately 2500 V, such that the ions generated from the MALDI source were sampled into the instrument (4000 QTRAP®) as shown in the lower pane, displaying peaks for the 3 peptides at m/z values of approximately 1047, 1061, and 1297. Next, the potential applied to the target plate was lowered to 560 V (i.e. a potential slightly lower than the 580 V applied to the heated chamber and curtain plate), completely eliminating all signal for the MALDI ions. Under these conditions, the electrosprayed ions contained within the curtain chamber were carried to the sampling inlet by a combination of the curtain gas flow and the potential gradient within the source, giving a mass spectrum dominated by the protonated reserpine ion as shown in the middle pane. In this manner, indexed ion sampling from the 2 different sources can still be achieved by controlling the potential applied to the MALDI target plate.

Example 8

Figure 22:
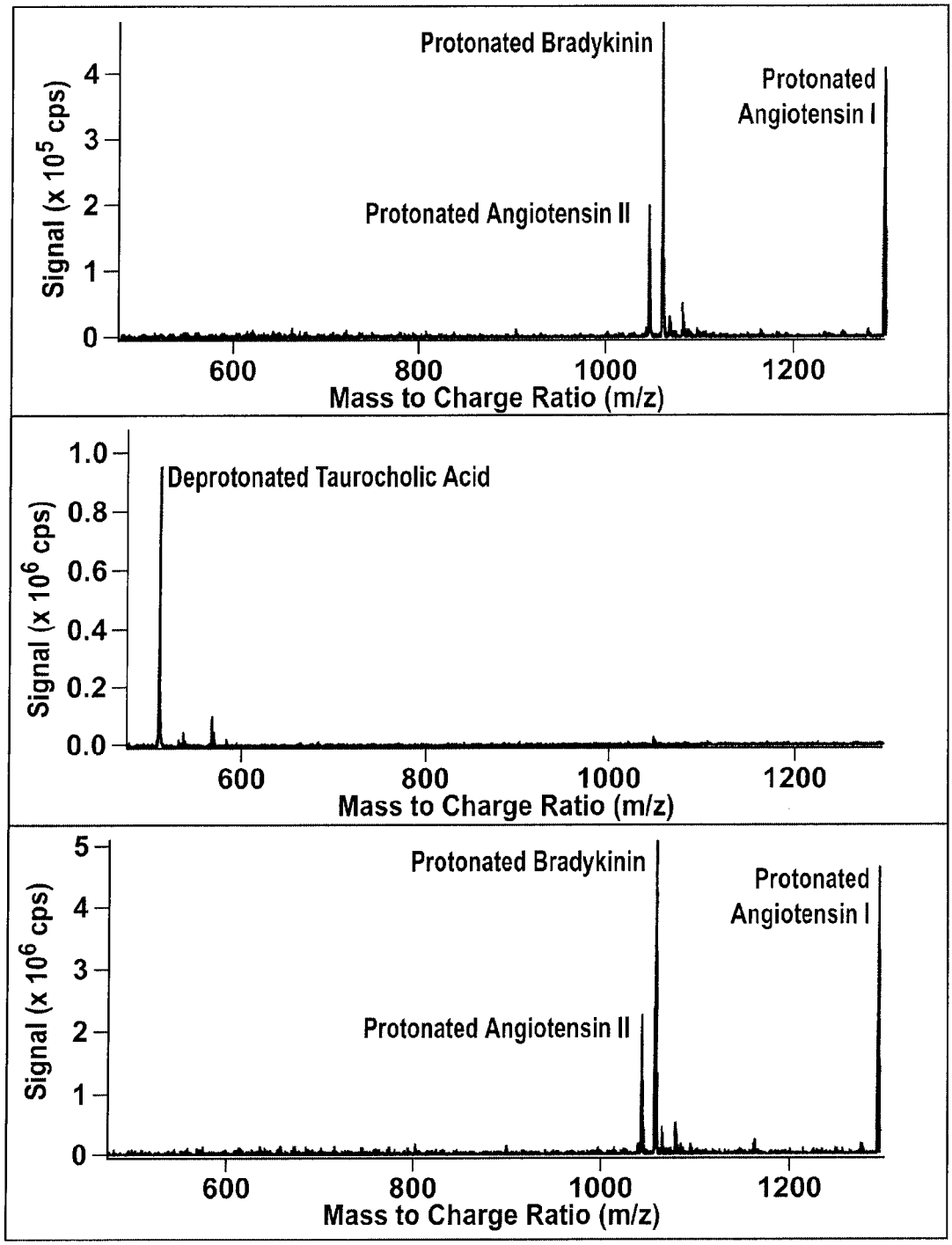

This experiment made use of a similar hardware configuration to that shown in FIG. 18, however, the nanoflow source was used to generate ions of opposite polarity to the peptides generated by the MALDI source to demonstrate the potential for the application of ion-ion chemistry as is known in the prior art, for instance using ion trapping devices. The curtain plate was located within approximately 4 mm of the heated inlet, and was designed such that it directed the curtain gas flow past the sampling inlet. A difficulty for ion-ion chemistry experiments is generating ions of positive and negative polarities simultaneously in front of a signal mass spectrometer inlet as the different potentials that are required can result in discharge or complete signal loss. The arrangement shown in FIG. 18 eliminates these problems as the first source can generate ions of a given polarity proximal to the sampling inlet, and the additional source can generate ions of the opposite polarity at a position substantially removed from the first source, such that there is no detrimental effect on the sampling of ions from the first source. The multiple sources can be contained within the same or preferably different source housings. For the data shown in FIG. 22, an atmospheric pressure MALDI source was used to generate positive ions from the same 3 peptide mixture used to generate the data presented in FIG. 21. The additional nanoflow source generated negative ions for a sample of 1000 pg/μL taurocholic acid sprayed directly into the 7 cm sampling tube. The initial potentials were 2500 V, 580 V, 580 V, 150 V, and −2500 V applied to the MALDI plate, curtain plate, heated laminar flow chamber, orifice, and nanoflow sprayer, respectively. The curtain gas was set to approximately 1 L/min and the nebulizer for the nanoflow sprayer was set to approximately 3 L/min. Both sources were set to continuously generate ions. Initially, the positive mode mass spectra showed the presence of the 3 peptides from the MALDI source, with no apparent signal from the nanoflow source as shown in the top pane. After approximately 1 min, the potential applied to the MALDI plate was lowered and the polarity of the instrument was switched to negative ion mode. The new potentials were −620 V, −620 V, −620 V, −150 V, and −2500 V applied to the MALDI plate, heated inlet, curtain plate, orifice plate, and nanoflow sprayer, respectively. Deprotonated taurocholic acid ions from the nanospray source were observed immediately as shown in the middle pane with the peak present at approximately m/z 514. The effective curtain gas flow past the sampling inlet eliminated the need for additional electric fields applied between the MALDI plate and the sampling inlet. After approximately 0.5 min, the instrumental polarity was switched back to positive ion mode and the potential applied to the MALDI plate was increased to 2500 V again to permit sampling of the peptide ions from the MALDI source. The data in FIG. 22 show that it is possible to simultaneously generate ions of opposite polarity from multiple sources and achieve indexing by switching the polarity of the instrument and adjusting the potential applied to the first source. As is known by those with skill in the relevant arts, the positive and negative ions generated with this device can be contained within a single ion trap for the purposes of conducting ion-ion reactions.

Example 9

Figure 23:
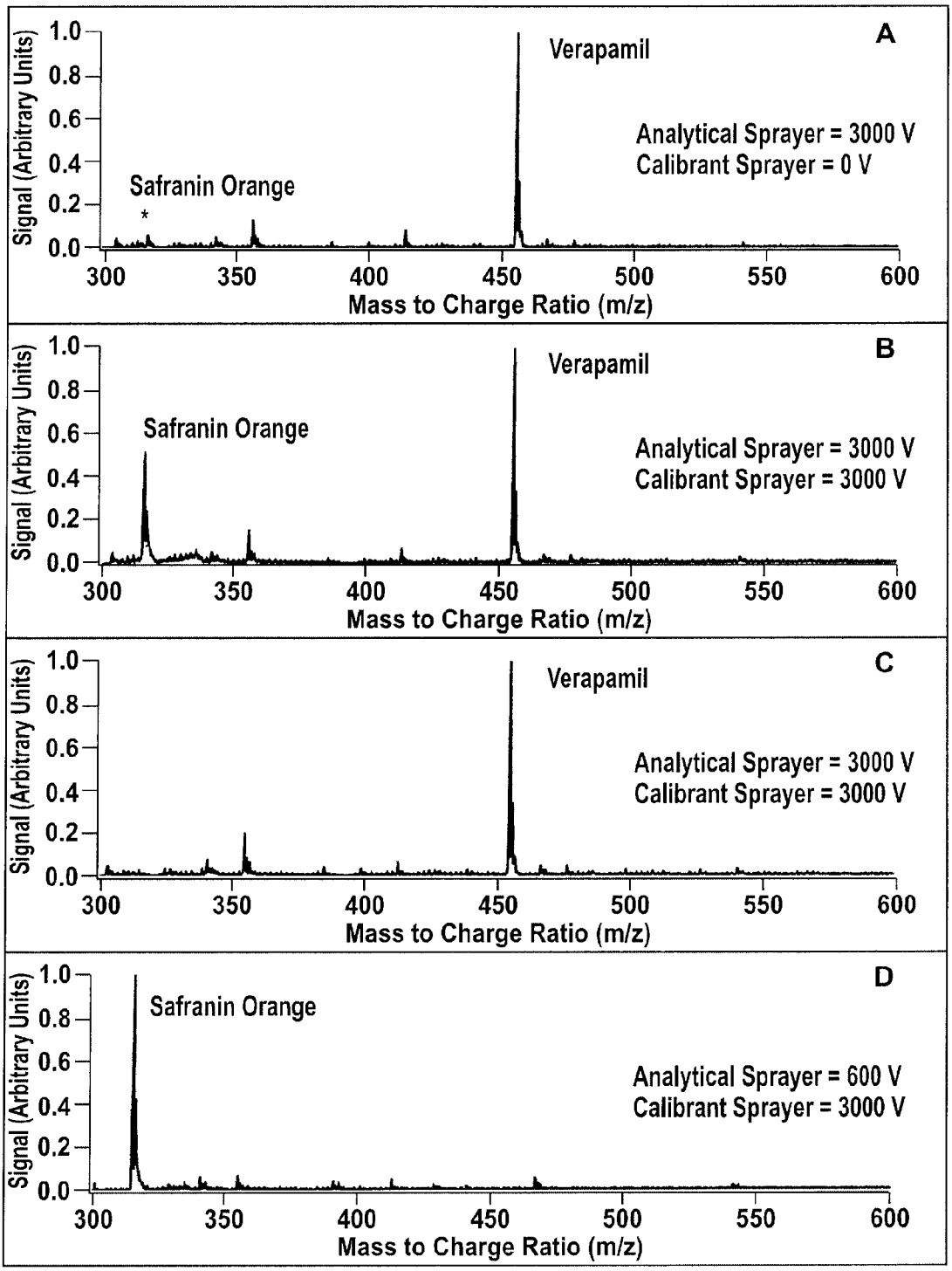

This experiment was conducted using a pair of nebulizer assisted nanoflow sprayers (MicroIonSpray II) with the configuration shown in FIG. 10. Samples containing verapamil and safranin orange were sprayed through the analytical sprayer and the calibrant sprayer, respectively. The potentials applied to the 2 sprayers were varied for the data presented in FIG. 23 while the nebulizer gas flows were fixed at 0.4 L/min and 3 L/min for the analytical sprayer and the calibrant sprayer, respectively. The laminar flow chamber was heated to 100° C. while potentials of 580 V, 580 V, and 50 V were applied to the heated laminar flow chamber, curtain plate, and orifice, respectively. Panes C and D demonstrate operation of the dual source for external calibration purposes because the analyte and calibrant ions are not present in the same spectrum. Pane D shows data generated with potentials of 580 V and 3000 V applied to the analytical sprayer and the calibrant sprayer, respectively. The mass spectrum shows the presence of a dominant peak corresponding to ions from the safranin orange calibrant flow. Increasing the analytical sprayer potential to 3000 V (Pane C) eliminated all signal for the calibrant ions and produced a dominant peak corresponding to ions from verapamil. As demonstrated in Panes A and B, this source configuration can also be used for internal calibration purposes where the analyte and calibrants are present in the same spectrum. When the calibrant nebulizer has the voltage off, neutral droplets and calibrant molecules are introduced into the transport gas. The neutral droplets and molecules that migrate in front of the inlet aperture collide with the charged droplets from the analytical sprayer thereby picking up charge and, upon partial evaporation, emit ions by ion evaporation. Free neutral molecules may also be ionized by gas phase charge transfer as shown previously in FIG. 8. Pane A shows an example of this, where the potential applied to the analytical sprayer was 3000 V and the potential applied to the calibrant sprayer was 0 V. The spectrum shows the presence of peaks corresponding to ions from both verapamil (analytical sprayer) and safranin orange (calibrant sprayer). Applying a negative potential to the calibrant sprayer introduces negatively charged droplets into the transport gas which are electrostatically attracted to the positive droplets from the analytical sprayer (or visa versa). As operated here, the negative droplets mix with the positive analytical electrospray and reverse polarity as a result of their interaction to emit positive ions. Pane B shows an example of this where the potential applied to the analytical sprayer was 3000 V and the potential applied to the calibrant sprayer was −3000 V. As demonstrated in FIG. 23, this mode of operation is more efficient at producing positive calibrant ions (approximately a 5× increase in safranin orange signal comparing Pane B to Pane A) than introducing neutral droplets, presumably because the electrostatic attraction improves the efficiency of the droplet interactions. Experiments with other calibrant molecules such as aztreonam, cyclosporine, succinyl choline, steroids, and peptides also showed improvements of approximately 3-5× when the calibrant sprayer was operated as a negative mode electrospray as opposed to a nebulizer. When operating in this fashion, calibrant signals improved as the heater temperature was reduced (more penetration of solvent into the curtain chamber), and as the analytical sprayer was positioned farther from the sampling inlet (more interaction time for the analytical spray with the droplets in the countercurrent gas flow).

Example 10

Figure 24:
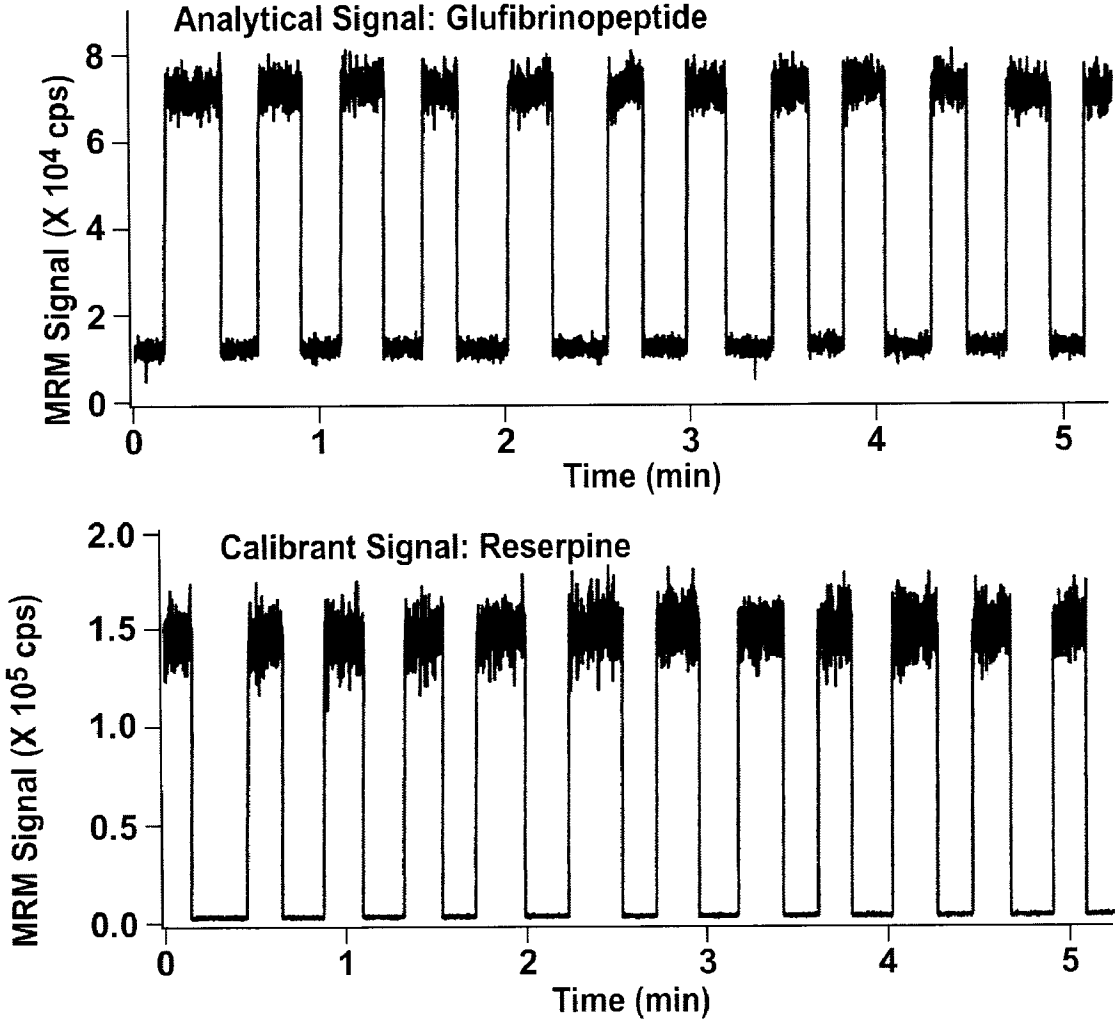
FIG. 24 shows MRM traces showing calibrant indexing in accordance with the applicants' teachings.
Figure 25:
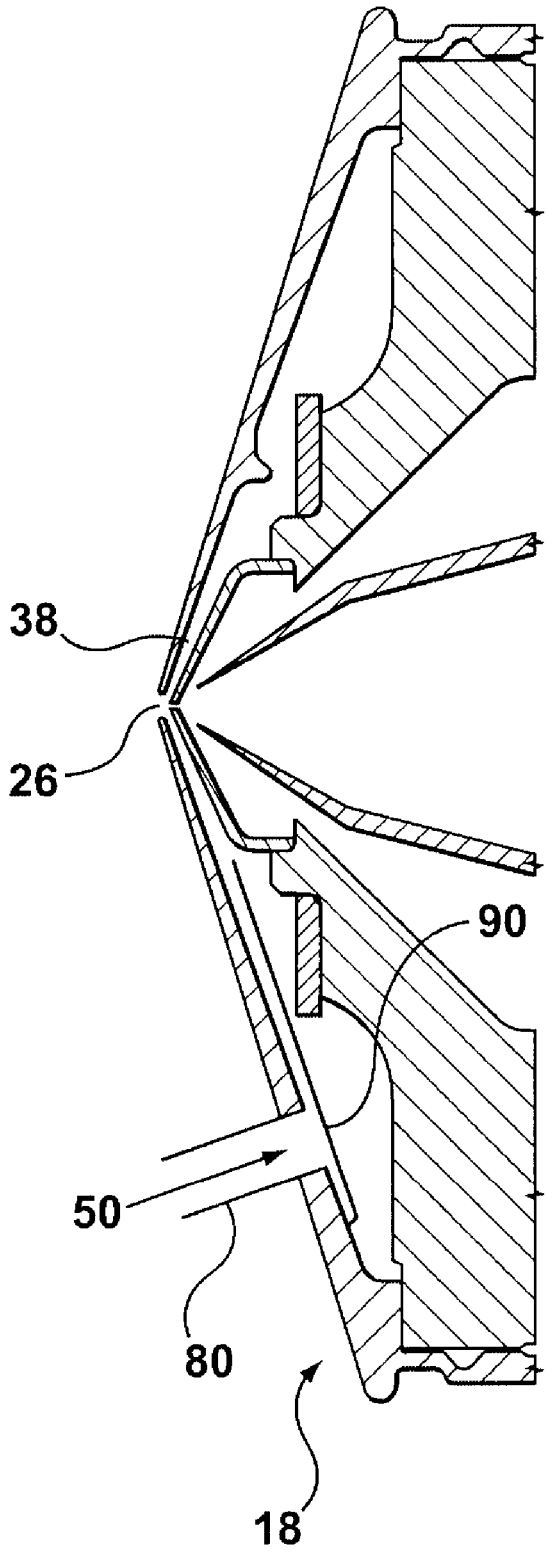
FIG. 25 shows a schematic diagram of an embodiment of an interface suitable for use in implementing the applicants' teachings.

Example 10 demonstrates internal calibration and an example of providing field-free conditions in accordance with the applicants' teachings. For this experiment, as shown in FIG. 25, a passage member 90 fabricated of sheet metal was placed on the back of the curtain plate (boundary member) 18 so that the calibrant ions were subjected to field free conditions as they were transported by gas flows from the edge of a second aperture 50 near the periphery of the curtain plate to the region between the curtain plate and a conductive orifice plate 38. A first source comprising an electrospray probe (Turbo V™ in this example) was positioned to spray orthogonally to the curtain plate aperture 26 (3 mm) located concentric to the sampling inlet, and a second source comprising a nanoflow sprayer made use of a nebulizer gas to establish a transport gas flow through a channel member 80, such as a tube, that was soldered onto the second aperture. In this fashion, calibrant ions and charged droplets passed through the channel member 80, followed by the second curtain plate aperture 50, and then the sheet metal passage member 90, prior to exiting into the region between the curtain plate and the sampling inlet. The electrospray source was positioned approximately 1 cm above the first curtain plate aperture and in an orthogonal configuration as understood by those skilled in the art and continuously generated ions from a sample of glufibrinopeptide, while the second source emitted reserpine ions into the channel member 80. With this configuration, calibrant ions could be sampled into the inlet along with analytical ions from the first source. As shown in FIG. 24, indexing of the calibrant ions could be achieved by varying the potential applied to the curtain plate (boundary member). For the data presented in FIG. 24, the applied potentials were 4500 V, 2800 V, and 100 V applied to the first source, calibrant source, and inlet orifice. The potential applied to the curtain plate was varied between 400 V and 100 V. The signal generated by the first electrospray source was optimized with 400 V applied to the curtain plate, and there was no signal for the calibrant ions. The calibrant ions exiting the passage member on the back or inside surface of the curtain plate (field free passage) were driven by the 300 V/mm field between the curtain plate and conductive orfice and discharged on the metal surface of the orifice plate. Decreasing the curtain plate potential to 100 V generated essentially field free conditions between the curtain plate and the orifice, thereby allowing calibrant ions to be sampled into the inlet along with a portion of the analytical sample. In this fashion, internal calibration can be achieved with switching times on the order of 50-70 ms.

As will be understood by those of ordinary skill in the relevant arts, once they have been made familiar with this disclosure, a wide variety of different interface configurations can be suitable for use in implementing the applicants' teachings. While the applicants' teachings have been described and illustrated in connection with various embodiments, many variations and modifications, as will be evident to those skilled in the relevant arts, can be made without departing from the spirit and scope of the applicants' teachings; and the applicants' teachings are thus not to be limited to the precise details of methodology or construction set forth above as such variations and modifications are intended to be included within the scope of the applicants' teachings. Except to the extent necessary or inherent in the processes themselves, no particular order to steps or stages of methods or processes described in this disclosure, including the Figures, is implied. In many cases the order of process steps can be varied without changing the purpose, effect, or import of the methods described.

It will be appreciated by those skilled in the relevant arts, from a reading of the disclosure, that various changes in form and detail can be made without departing from the true scope of the applicants' teachings in the appended claims.

What is claimed is:

1. A method for introducing samples to a mass spectrometer from at least two sources, the method comprising:

introducing a first of the samples through a first entrance point in a chamber in communication with a sampling inlet to the mass spectrometer, the first entrance point being defined in a boundary member that at least partially defines the chamber, the first entrance point being coaxial to the sampling inlet, the chamber having at least one region where field-free conditions are established, the first of the samples being introduced substantially adjacent to the sampling inlet; and introducing at least a second of the samples through at least one other entrance point defined in the chamber at a non-adjacent position to the sampling inlet; the chamber further defines a gas entrance for introducing a gas into the chamber, wherein a gas flow stream is established in which the gas flow stream flows partially toward the first entrance point and partially toward the sampling inlet, whereby at least the second of the samples is directed to the sampling inlet by the gas flow stream.

2. The method according to claim 1, wherein the introducing the first of the samples is associated with an electromagnetic field and the introducing the at least one other entrance point is sufficiently remote from the first entrance point such that the introduction of at least the second of the samples does not have a detrimental effect on the analysis of the first of the samples by the mass spectrometer.

3. The method according to claim 1, wherein the first entrance point is located at a distance of at least 3 millimeters from the at least one other entrance point.

4. The method according to claim 1, wherein at least one of the samples comprises ions or charged droplets.

5. The method according to claim 4, wherein at least the second of the samples comprises ions or charged droplets of opposite polarity to the first of the samples.

6. The method according to claim 5, wherein ions of the first of the samples and ions of the second of the samples are mixed together to conduct ion-ion reactions.

7. The method according to claim 5, wherein the first of the samples and the second of the samples are mixed together to generate ions from the second of the samples having the same polarity as of the first of the samples.

8. The method according to claim 4, wherein at least the second of the samples comprises neutral molecules.

9. The method according to claim 8, wherein the neutral molecules become charged before they are analyzed by the mass spectrometer.

10. The method according to claim 8, wherein ions of the first of the samples and neutrals of the second of the samples are mixed together to conduct ion-neutral reactions.

11. The method according to claim 4, wherein ions of the first of the samples and ions of the second of the samples are gated to conduct external calibration.

12. The method according to claim 4, wherein the first of the samples and the second of the samples are mixed together to conduct internal calibration.

13. The method according to claim 1, further comprising providing at least one heat source.

14. The method according to claim 1, wherein the sampling inlet is heated.

15. The method according to claim 1, wherein at least the second of the samples comprises calibrant molecules.

16. The method according to claim 1, further comprising gating the introducing the first of the samples and the second of the samples into the sampling inlet.

17. The method according to claim 16, further comprising gating the at least the second of the samples by alternating the potential applied to the first of the samples.

18. The method according to claim 16, wherein the gating comprises varying a potential applied to the boundary member.

19. The method according to claim 1, wherein the first of the samples is introduced through the first entrance point as a spray of charged droplets of a first polarity and the second of the samples is introduced through the at least one other entrance point as one of a spray of droplets of an opposite polarity to the charged droplets of the first of the samples, and a spray of droplets of neutral polarity and the droplets from the second of the samples are mixed with the droplets from the first of the samples.

20. The method according to claim 1, further comprising providing a channel member attached to the at least one other entrance point.

21. The method according to claim 20, further comprising providing a passage member attached to the inside of the boundary member, the passage member positioned adjacent to the at least one other entrance point for providing field-free conditions to at least one region of the chamber.

22. The method according to claim 1, further comprising providing a passage member attached to the inside of the boundary member, the passage member positioned adjacent to the at least one other entrance point for providing field-free conditions to at least one region of the chamber.

23. An interface apparatus for introducing at least one sample into a mass spectrometer, the interface apparatus comprising, a sampling inlet to the mass spectrometer;

a boundary member at least partially defining a chamber in communication with the sampling inlet, the chamber having at least one region where field-free conditions are established;

a first aperture defined in the boundary member through which a first source can emit a sample, the first aperture being coaxial to the sampling inlet and the sample being directed toward the sampling inlet for passage therethrough;

and at least one other aperture defined in the chamber through which at least one other source can introduce at least one of the sample or another sample into the chamber; and further a gas entrance for introducing a gas into the chamber, wherein a gas flow stream is established in which the gas flow stream flows partially toward the first aperture defined in the boundary member and partially toward the sampling inlet, whereby at least one of the sample or another sample from the at least one other aperture defined in the chamber is directed to the sampling inlet by the gas flow stream.

* * * * *